US011612300B2

(12) United States Patent
Harr et al.

(10) Patent No.: US 11,612,300 B2
(45) Date of Patent: Mar. 28, 2023

(54) CONFIGURABLE LOWER RACK FOR DISHWASHER

(71) Applicants: BSH Home Appliances Corporation, Irvine, CA (US); BSH Hausgeräte GmbH, Munich (DE)

(72) Inventors: Deborah Harr, New Bern, NC (US); Art Parrish, Newport, NC (US); Matthew Richards, New Bern, NC (US); Napat Wanweerakul, Trent Woods, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 128 days.

(21) Appl. No.: 16/904,832

(22) Filed: Jun. 18, 2020

(65) Prior Publication Data

US 2021/0393108 A1 Dec. 23, 2021

(51) Int. Cl.
*A47L 15/50* (2006.01)

(52) U.S. Cl.
CPC ..... *A47L 15/502* (2013.01); *A47L 15/503* (2013.01); *A47L 15/505* (2013.01); *A47L 15/507* (2013.01)

(58) Field of Classification Search
CPC .... A47L 15/502; A47L 15/505; A47L 15/507; A47L 15/50; A47L 15/503
See application file for complete search history.

(56) References Cited

U.S. PATENT DOCUMENTS 3,214,031 A * 10/1965 McCauley ..... A47B 81/04 D7/704
4,046,261 A 9/1977 Yake
4,589,556 A * 5/1986 Peretz ..... A47L 15/505 211/41.2
4,606,464 A 8/1986 Jordan et al.
4,917,248 A 4/1990 Friskney et al.
5,158,185 A 10/1992 Michael et al.
5,351,837 A 10/1994 Smith
(Continued)

FOREIGN PATENT DOCUMENTS

CN 204618160 U * 9/2015
CN 204683531 U * 10/2015
(Continued)

*Primary Examiner* — Kimberley S Wright
(74) *Attorney, Agent, or Firm* — Michael E. Tschupp; Andre Pallapies; Brandon G. Braun

(57) ABSTRACT

A washware rack assembly including: a basket formed by a plurality of wire-shaped elements, the plurality of wire-shaped elements including a bottom portion and a side wall portion; and a plurality of removable, preformed rows of tines configured to mount to the basket. The plurality of removable, preformed rows of tines include tines having a first, fixed spacing and tines having a second, fixed spacing which is different than the first, fixed spacing. A pair of the removable, preformed rows of tines having the first, fixed spacing is disposed in parallel in one section of the basket, and a pair of the removable, preformed rows of tines having the second, fixed spacing is disposed in parallel in another section of the basket, such that the washware rack assembly is configured to accommodate washware of different sizes in different sections of the basket.

20 Claims, 16 Drawing Sheets

(56) References Cited

U.S. PATENT DOCUMENTS 5,480,035 A * 1/1996 Smith ..... A47L 15/503 211/168
5,601,195 A 2/1997 Finalo et al.
6,109,455 A 8/2000 Schroeder
6,571,965 B1 6/2003 Beck et al.
6,827,225 B2 12/2004 Miilu et al.
6,848,585 B2 2/2005 VanLandingHam
D605,909 S * 12/2009 Wax ..... D7/704
7,682,465 B2 3/2010 Anderson et al.
7,793,790 B2 9/2010 Lee
7,931,155 B2 * 4/2011 Bastuji ..... A47L 15/503 211/41.9
7,984,812 B2 7/2011 Pike et al.
8,104,628 B2 1/2012 Kim
8,540,085 B2 9/2013 Klump et al.
8,646,620 B2 2/2014 Klump et al.
8,651,287 B2 * 2/2014 Moser ..... A47L 15/503 211/195
8,820,544 B2 9/2014 Lindgren et al.
9,901,240 B2 2/2018 Lee
9,924,851 B2 3/2018 Kulkarni
9,949,613 B2 * 4/2018 Blanchard ..... A47L 15/50
11,147,430 B2 * 10/2021 Wilson ..... A47L 15/0007
2005/0109378 A1 * 5/2005 Landsiedel ..... A47L 15/14 134/135
2008/0302740 A1 * 12/2008 Moser ..... A47L 15/503 211/41.8
2009/0255888 A1 * 10/2009 Melvin ..... A47L 19/04 211/85.29
2013/0299438 A1 * 11/2013 McDaniel ..... A47L 15/505 211/41.9
2018/0055333 A1 * 3/2018 Blanchard ..... A47L 15/50
2020/0305680 A1 * 10/2020 Wilson ..... A47L 15/0005
2020/0329947 A1 * 10/2020 Clerkin ..... A47L 15/4278

FOREIGN PATENT DOCUMENTS

CN 106137085 A * 11/2016
CN 106214100 A * 12/2016 ..... A47L 15/502
CN 206239378 U * 6/2017
CN 209346967 U * 9/2019
CN 209884088 U 1/2020

* cited by examiner

CONFIGURABLE LOWER RACK FOR DISHWASHER

FIELD OF THE INVENTION

The present disclosure relates generally to dishwasher appliances and to racks for holding dishware and cutlery for a dishwasher. More particularly, the present disclosure relates to a washware rack that has a customizable tine layout including removable, preformed rows of tines configured to mount to a bottom portion of the washware rack in different sections thereof.

The washware rack may be a lower modular washware rack in the form of a basket, and the different sections of the basket comprise four quadrants of substantially equal size. The removable, preformed rows of tines may be interchangeable within each quadrant.

BACKGROUND OF THE INVENTION

In general, most domestic dishwashers include two washware or dishware racks to support items to be washed such as dishware, glassware, kitchen utensils, pots, pans, and the like. Typically, the two washware racks include an upper washware rack positioned near a top portion of the dishwasher, and a lower washware rack arranged below the upper washware rack. The upper washware rack is used to support glassware, utensils, and other small items, while the lower washware rack is used to support larger items, such as dinner plates, large bowls, cooking sheets, and baking pans. Some dishwashers also include a third, top washware rack arranged immediately above a second or middle washware rack and for holding smaller items such as utensils, cups, and small bowls. The second, middle washware rack is in turn positioned above a first, bottom or lower washware rack inside the dishwashing compartment. The washware racks are normally formed from several discrete lengths of wire, welded together and then covered with a rubber or a plastic coating. Further, the various washware racks are typically formed with a plurality of vertically projecting, fixed tines and/or fixed ribs to support and organize the items placed on the washware rack.

Customers today have a large variety of different styles/shapes/sizes of kitchenware and thus one style or layout of a washware rack, such as a lower washware rack, cannot meet the customers' needs. Because of this, conventional washware racks having fixed tines and fixed ribs or forms limit the customers' options when it comes to loading the washware rack.

SUMMARY OF THE INVENTION

The present inventors have observed that conventional washware racks simply do not meet the needs of most users of dishwashers. In particular, users/customers would find it beneficial to have more flexibility and be able to customize the tine layout in a washware rack to be able to accommodate their current kitchenware.

An apparatus consistent with the present disclosure is directed to providing a washware rack that has a customizable tine layout including removable, preformed rows of tines configured to mount to a bottom portion of the washware rack in different sections thereof. The different sections can be four quadrants of substantially equal size.

An apparatus consistent with the present disclosure is directed to providing a customizable tine layout for all four quadrants.

An apparatus consistent with the present disclosure is directed to providing a customizable orientation of the tines in the form of: a horizontal arrangement (i.e., washware arranged from side-to-side of the washware rack), a vertical arrangement (i.e., washware arranged from front-to-back of the washware rack), or a mix and match arrangement of both horizontal and vertical.

An apparatus consistent with the present disclosure is directed to providing customizable tine width spacing between tine rows.

An apparatus consistent with the present disclosure is directed to providing various tine-slot spacing (i.e., the fixed spacing between the individual tines can be different for individual tine rows).

An apparatus consistent with the present disclosure is directed to providing specialty item holders such as, for example, a wine glass holder, a bottle holder, a lid holder, or the like.

An apparatus consistent with the present disclosure is directed to providing tines that can be folded down when not in use.

According to one aspect, the present disclosure provides a dishwasher, comprising: a dishwashing compartment having a loading opening; a door configured to close the loading opening; and at least one washware rack configured as a basket formed by a plurality of wire-shaped elements, the plurality of wire-shaped elements including a bottom portion and a side wall portion and being configured for movement out of and into the dishwashing compartment, wherein the at least one washware rack comprises a plurality of removable, preformed rows of tines configured to mount to the basket, the plurality of removable, preformed rows of tines including at least tines having a first, fixed spacing and tines having a second, fixed spacing which is different than the first, fixed spacing, and wherein a pair of the removable, preformed rows of tines having the first, fixed spacing is disposed in parallel in one section of the basket, and a pair of the removable, preformed rows of tines having the second, fixed spacing is disposed in parallel in another section of the basket, such that the at least one washware rack is configured to accommodate washware of different sizes in different sections of the basket.

According to another aspect, the different sections of the basket comprise four quadrants of substantially equal size.

According to another aspect, each of the four quadrants of the basket includes a pair of the removable, preformed rows of tines disposed in parallel, and wherein a fixed spacing of the tines of the removable, preformed rows of tines in one quadrant is different than the fixed spacing of the tines of the removable, preformed rows of tines in the other quadrants in order to accommodate washware of different sizes.

According to another aspect, the pair of the removable, preformed rows of tines disposed in parallel in each of the four quadrants is adjustable with respect to the plurality of wire-shaped elements of the bottom portion of the basket in order to vary the spacing between the pair of the removable, preformed rows of tines disposed in parallel in each of the four quadrants.

According to another aspect, the pair of the removable, preformed rows of tines disposed in parallel in each of the four quadrants is configured to be removed and replaced by another pair of the removable, preformed rows of tines having a different fixed spacing between the tines.

According to another aspect, at least one of the four quadrants accommodates a specialty item holder including at least one of a wine glass holder, a bottle holder, or a lid holder.

According to another aspect, the at least one washware rack comprises a lower modular washware rack.

According to another aspect, the present disclosure provides a washware rack assembly for a dishwasher configured to receive washware therein and to be inserted into and removed from a dishwashing compartment of the dishwasher, the washware rack assembly comprising: basket formed by a plurality of wire-shaped elements, the plurality of wire-shaped elements including a bottom portion and a side wall portion; and a plurality of removable, preformed rows of tines configured to mount to the basket, the plurality of removable, preformed rows of tines including at least tines having a first, fixed spacing and tines having a second, fixed spacing which is different than the first, fixed spacing, wherein a pair of the removable, preformed rows of tines having the first, fixed spacing is disposed in parallel in one section of the basket, and a pair of the removable, preformed rows of tines having the second, fixed spacing is disposed in parallel in another section of the basket, such that the washware rack assembly is configured to accommodate washware of different sizes in different sections of the basket.

According to another aspect, the different sections of the basket comprise four quadrants of substantially equal size.

According to another aspect, each of the four quadrants of the basket includes a pair of the removable, preformed rows of tines disposed in parallel, and wherein a fixed spacing of the tines of the removable, preformed rows of tines in one quadrant is different than the fixed spacing of the tines of the removable, preformed rows of tines in the other quadrants in order to accommodate washware of different sizes.

According to another aspect, the pair of the removable, preformed rows of tines disposed in parallel in each of the four quadrants is adjustable with respect to the plurality of wire-shaped elements of the bottom portion of the basket in order to vary the spacing between the pair of the removable, preformed rows of tines disposed in parallel in each of the four quadrants.

According to another aspect, the pair of the removable, preformed rows of tines disposed in parallel in each of the four quadrants is configured to be removed and replaced by another pair of the removable, preformed rows of tines having a different fixed spacing between the tines.

According to another aspect, at least one of the four quadrants accommodates a specialty item holder including at least one of a wine glass holder, a bottle holder, or a lid holder.

According to another aspect, the washware rack assembly comprises a lower modular washware rack.

According to another aspect, the present disclosure provides a washware rack assembly for a dishwasher configured to receive washware therein and to be inserted into and removed from a dishwashing compartment of the dishwasher, the washware rack assembly comprising: a basket formed by a plurality of wire-shaped elements, the plurality of wire-shaped elements including a bottom portion and a side wall portion, with the basket comprising four quadrants of substantially equal size; and a plurality of removable, preformed rows of tines configured to mount to the basket, the plurality of removable, preformed rows of tines including tines having first, second, third, and fourth fixed spacing which are different from each other, with the tines having the first, second, third, and fourth fixed spacing being configured to be respectively disposed in a corresponding one of the four quadrants of the basket, wherein a pair of the removable, preformed rows of tines having one of the first, second, third, and fourth fixed spacing is configured to be disposed in parallel in each of the four quadrants of the basket, with at least two of the four quadrants of the basket having pairs of the removable, preformed rows of tines with a different one of the first, second, third, and fourth fixed spacing between the tines, and wherein the pair of the removable, preformed rows of tines configured to be disposed in parallel in each of the four quadrants of the basket is configured to be removed and replaced by another pair of the removable, preformed rows of tines having a different one of the first, second, third, and fourth fixed spacing between the tines, such that the washware rack assembly is configured to accommodate washware of different sizes in different quadrants of the basket.

According to another aspect, the pair of the removable, preformed rows of tines disposed in parallel in each of the four quadrants of the basket is adjustable with respect to the plurality of wire-shaped elements of the bottom portion of the basket in order to vary the spacing between the pair of the removable, preformed rows of tines disposed in parallel in each of the four quadrants of the basket.

According to another aspect, at least one of the four quadrants is configured such that the pair of the removable, preformed rows of tines disposed in parallel is removed and replaced by a specialty item holder including at least one of a wine glass holder, a bottle holder, or a lid holder.

According to another aspect, the washware rack assembly comprises a lower modular washware rack.

According to another aspect, each of the plurality of removable, preformed rows of tines is mounted at opposite ends to the bottom portion of the basket via holding members that clip onto corresponding wire-shaped elements.

According to another aspect, each of the plurality of removable, preformed rows of tines is directly mounted at opposite ends to the bottom portion of the basket.

BRIEF DESCRIPTION OF THE DRAWING FIGURES

The accompanying drawing figures incorporated in and forming a part of this specification illustrate several aspects of the invention, and together with the description serve to explain the principles of the invention.

FIG. 1 is a front perspective view of a dishwasher appliance with the door open so as to reveal the dishwashing compartment including a washware rack assembly that is configured to accommodate washware of different sizes in different sections according to an exemplary embodiment consistent with the present disclosure;

FIGS. 2A to 2F show customizable orientation of the tines in the form of: a horizontal arrangement (i.e., washware arranged from side-to-side of the washware rack)-FIGS. 2A and 2B, a vertical arrangement (i.e., washware arranged from front-to-back of the washware rack)—FIGS. 2C and 2D, or a mix and match arrangement of both horizontal and vertical—FIGS. 2E and 2F, according to an exemplary embodiment consistent with the present disclosure;

FIGS. 3A, 3B, 3C, and 3D show customizable tine width spacing between tine rows and customizable location according to an exemplary embodiment consistent with the present disclosure;

Figure 8:
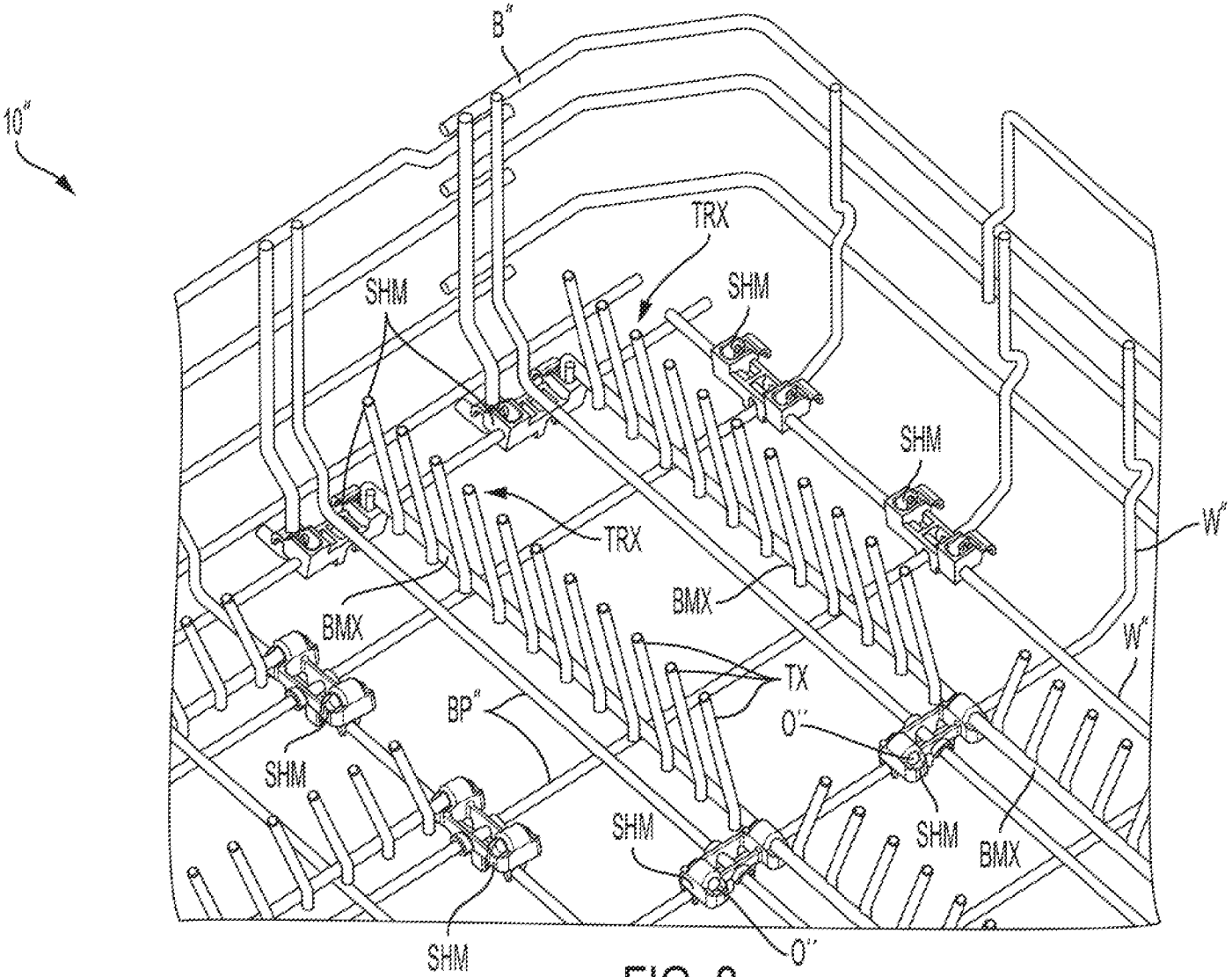
FIG. 8 shows a fragmentary perspective view of an alternative form of holding members according to an exemplary embodiment consistent with the present disclosure.
Figure 9A:
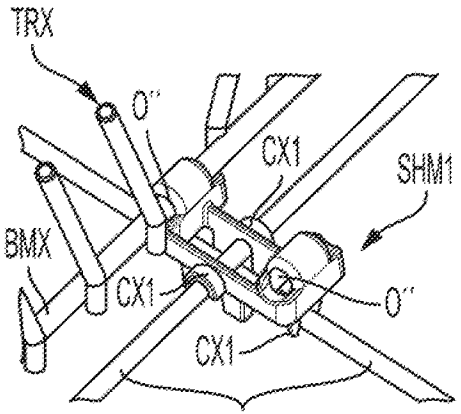
Figure 9B:
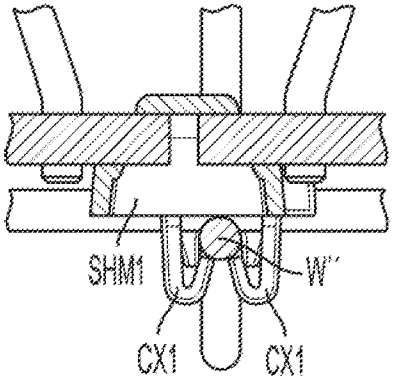
Figure 9C:
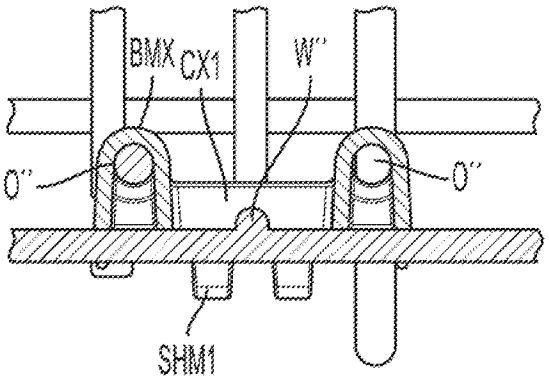
Figure 9D:
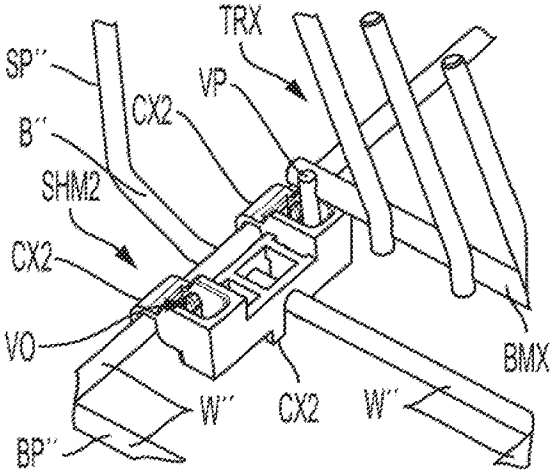
Figure 9E:
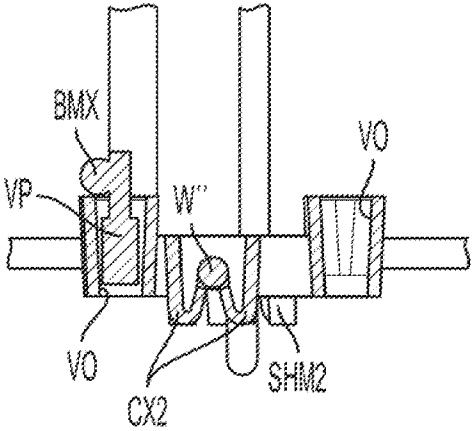
Figure 9F:
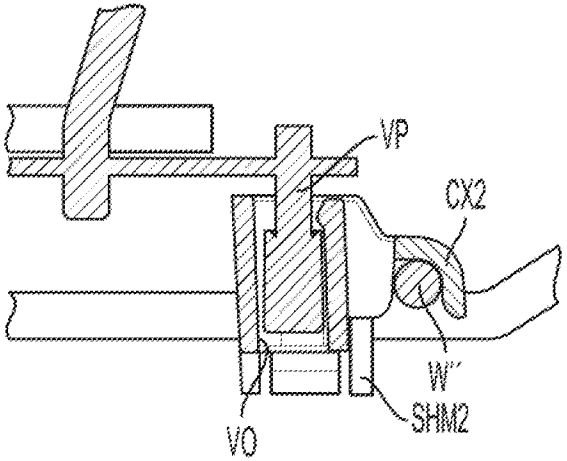
Figure 10B:
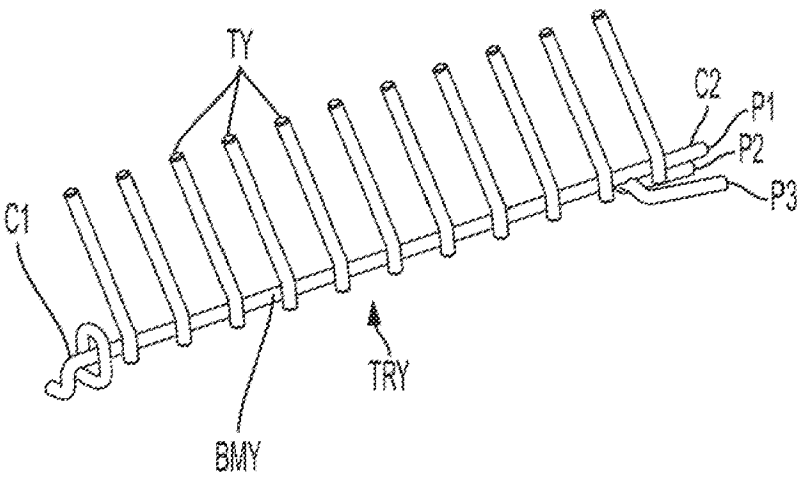
Figure 10A:
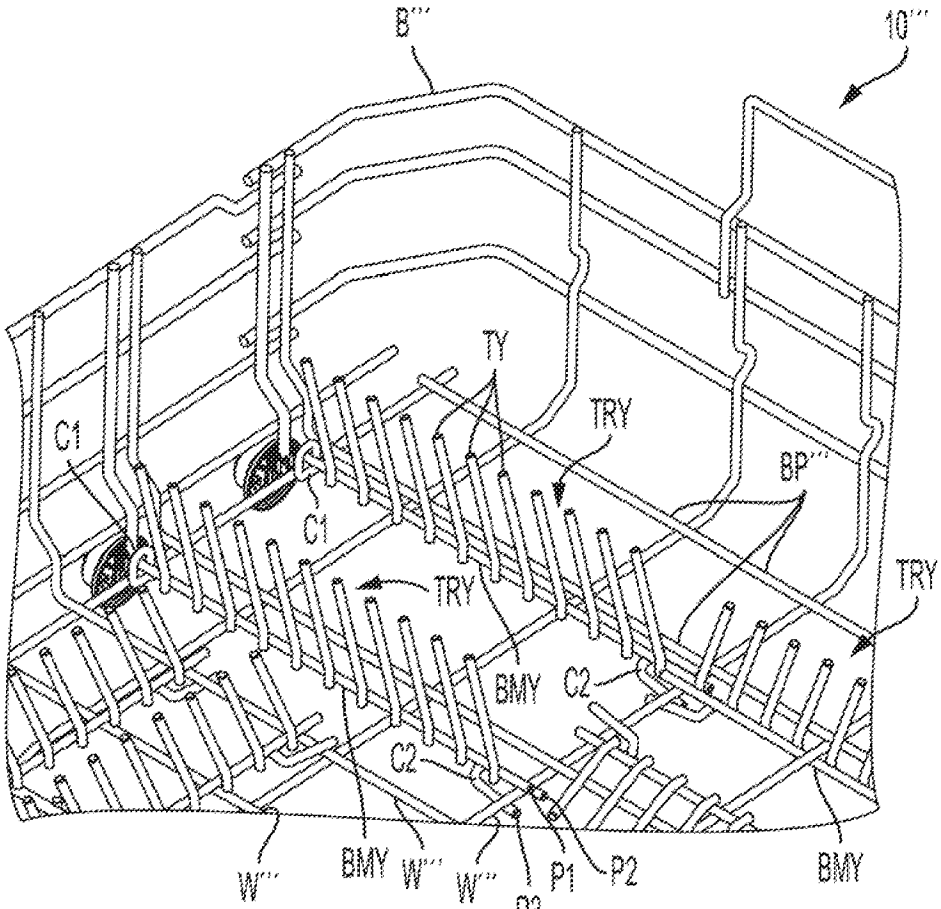

FIGS. 9A-9F are enlarged and sectional views of the alternative form of holding members of FIG. 8; and FIGS. 10A and 10B are a fragmentary perspective view and a view of an individual tine row, respectively, showing an alternative form of the tine row where the tine row is directly mounted at opposite ends to the bottom portion of the basket according to an exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
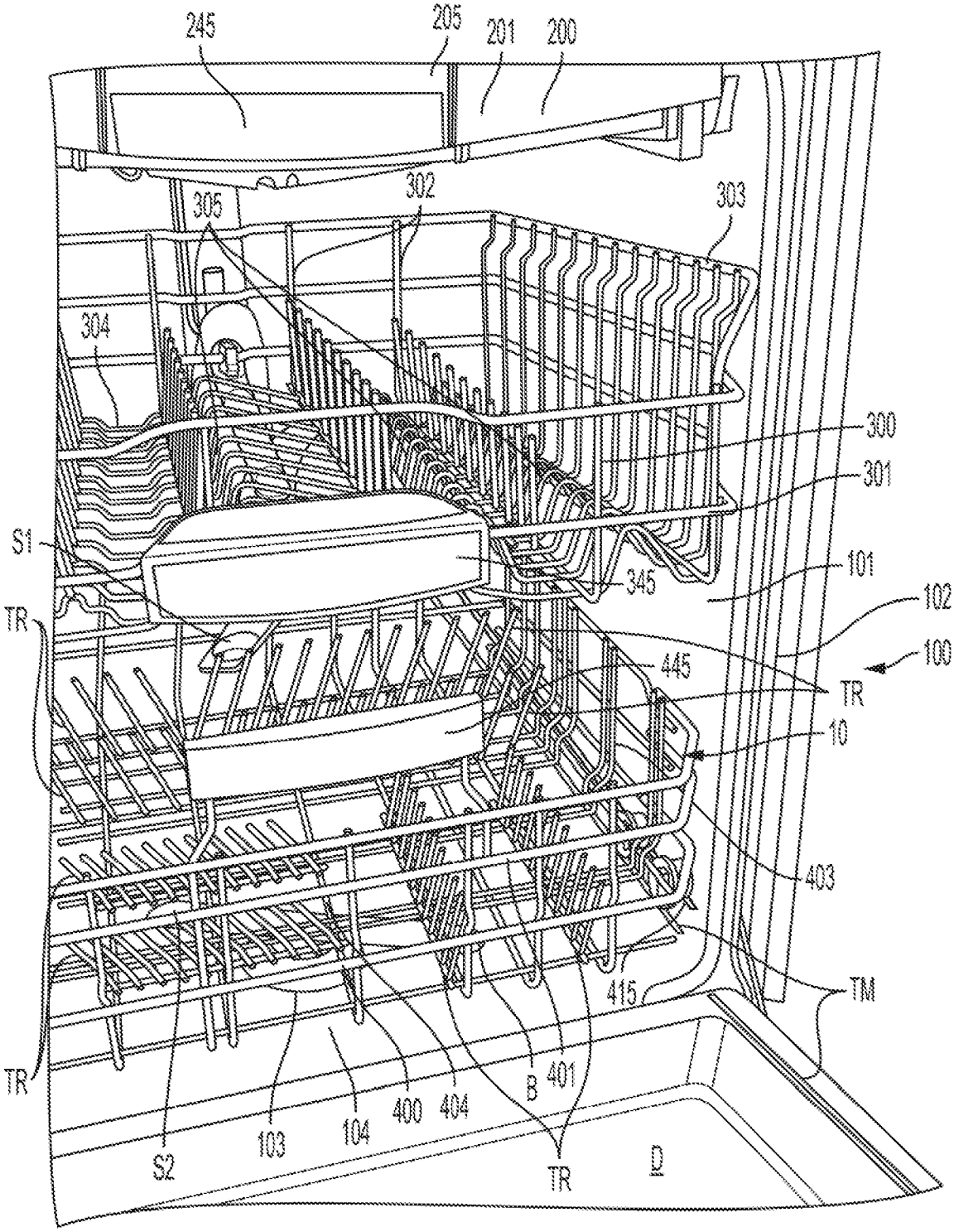

FIG. 1 is a front perspective view of a dishwasher appliance 100 according to an exemplary embodiment consistent with present disclosure, with the door D open so as to reveal the dishwashing compartment 101 having a loading opening 102 and including a third, top washware rack 200 that is positioned immediately above a second or middle washware rack 300. The middle washware rack 300 is in turn positioned above a first, bottom or lower washware rack 400. As will be describe in detail below, the lower washware rack 400, for example, is provided in the form of a configurable washware rack assembly or washware rack assembly 10 (see FIGS. 2A-10B) that is configured to accommodate washware of different sizes in different sections according to an exemplary embodiment consistent with the present disclosure.

As shown in FIG. 1, the dishwasher appliance 100 may also include rotating sprayer arms S1 and S2, and a drain 103 in a tub 104. The door D may include a washing agent dispenser (not shown). Also, although not shown, as is known in the art, the dishwasher appliance 100 includes a pump and filter assembly, a heating element, a drain hose, and can include additional spray devices. A detailed description of the suitable structure and operation of the dishwasher appliance 100 does not form part of the present disclosure, but can be found, for example, in U.S. Pat. Nos. 9,445,703 and 9,510,729 which are incorporated herein by reference.

More specifically, the first, bottom or lower washware rack 400 is normally configured as a basket for holding larger plates, large bowls, pans, cookware such as a cooking sheet, etc. The bottom or lower washware rack 400 is configured as a basket B that includes a sidewall portion including front 401, rear (not shown), and opposing side walls 403 (one of which is visible) interconnected with a bottom portion 404 and formed by a plurality of wire-shaped elements. The bottom or lower washware rack 400 normally includes a plurality of vertically extending fixed tines or tine members; however, the bottom washware rack 400 is devoid of any such fixed tines. Instead, consistent with the present disclosure, the basket B comprises different sections such as, for example, four quadrants of substantially equal size, and removable, preformed rows of tines TR may be interchangeable within each quadrant, as will be discussed below. At the bottom portion of the bottom or lower washware rack 400 at the left and right sides thereof, rollers 415 are provided and are configured to run on corresponding flanges or track members TM on the inside wall of the dishwashing compartment 101 and also on an inside surface of the door D, as is conventional in the art. The bottom washware rack 400 can include a handle 445.

The second or middle washware rack 300 is positioned immediately above the bottom washware rack 400. The middle washware rack 300 is configured as a basket to hold medium sized dishes, bowls such as medium sized bowls, and glasses. The middle washware rack 300 includes front 301, rear 302, and opposing side walls 303 (one of which is visible) interconnected with a bottom portion 304 and formed by a plurality of wire-shaped elements. The bottom portion 304 includes a plurality of forms or ribs 305 for holding items in place on the middle washware rack 300. The middle washware rack 300 can include a handle 345.

As noted above, the bottom washware rack 400 and the middle washware racks 300 are formed of wire-shaped elements that are configured to have a basket shape. The wire-shaped elements of the bottom and middle washware racks 400 and 300, respectively, may be formed of solid plastic, metal wire coated with plastic or rubber, or composite materials.

As shown in FIG. 1, the third, top washware rack 200 is configured to hold cutlery and washware which is larger than cutlery such as, but not limited to, small dishes, bowls, cups, as well as cooking utensils. The third, top washware rack 200 includes front 201, rear (not shown), and opposing side walls (not shown) and can be a combination of a wire frame covered with a plastic piece, or entirely out of plastic. The third, top washware rack 200 can also be formed by a plurality of wire-shaped elements formed either entirely out of metal (such as stainless steel), or metal (such as carbon steel) dipped in, for example, a Nylon powder so that the wire is coated. The third, top washware rack 200 can include a form or recess 205 on the front wall 201 for mounting thereon a handle 245.

The configurable washware rack assembly 10 (also referred to as the washware rack assembly 10) will now be described with reference to FIGS. 2A-10B. While the configurable washware rack assembly 10 is described below in connection with the lower washware rack 400, other washware racks, such as the middle washware rack 300 or upper washware rack 200 can also be configured to accommodate washware of different sizes in different sections consistent with the present disclosure.

Figure 2A:
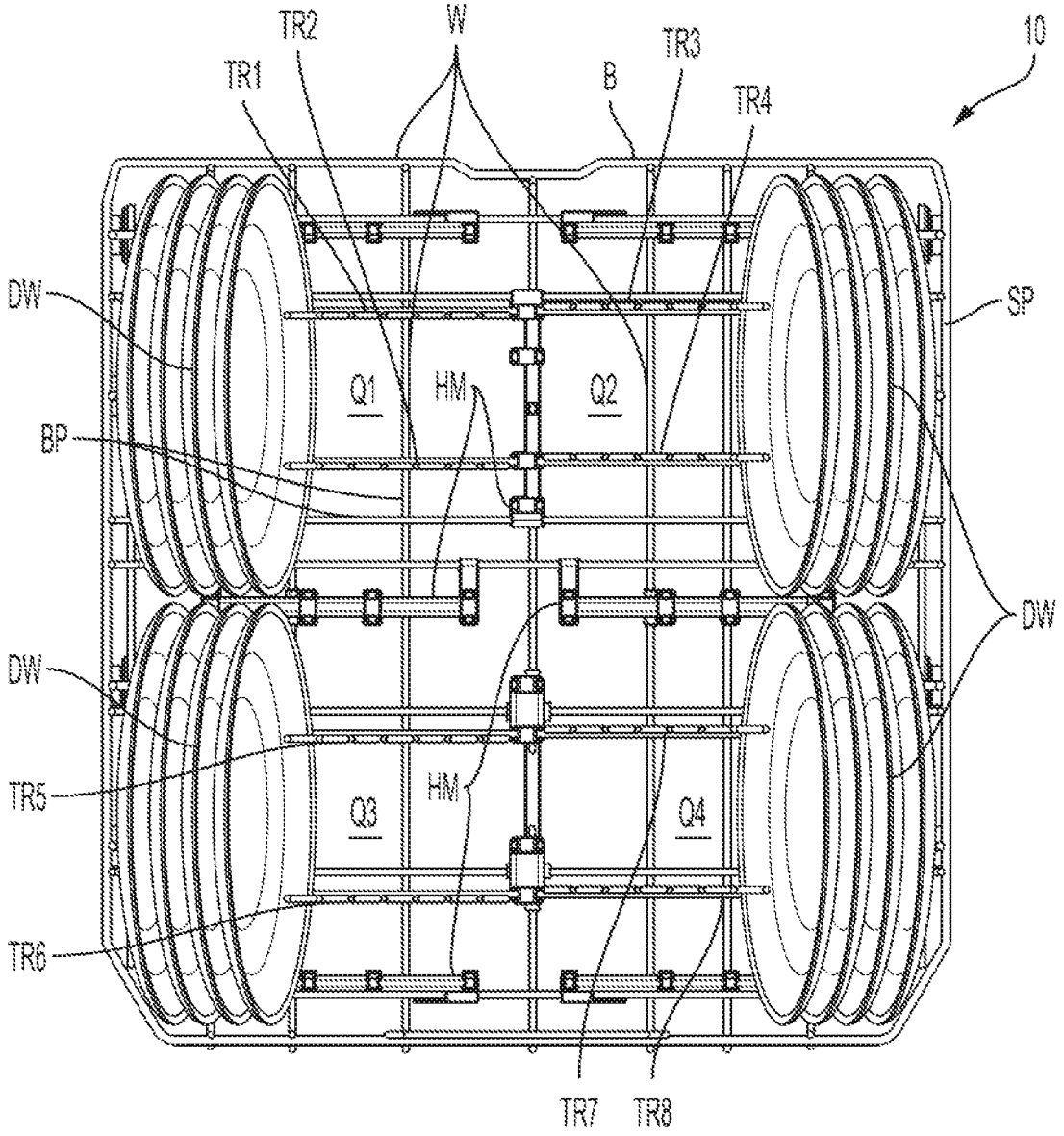
Figure 2B:
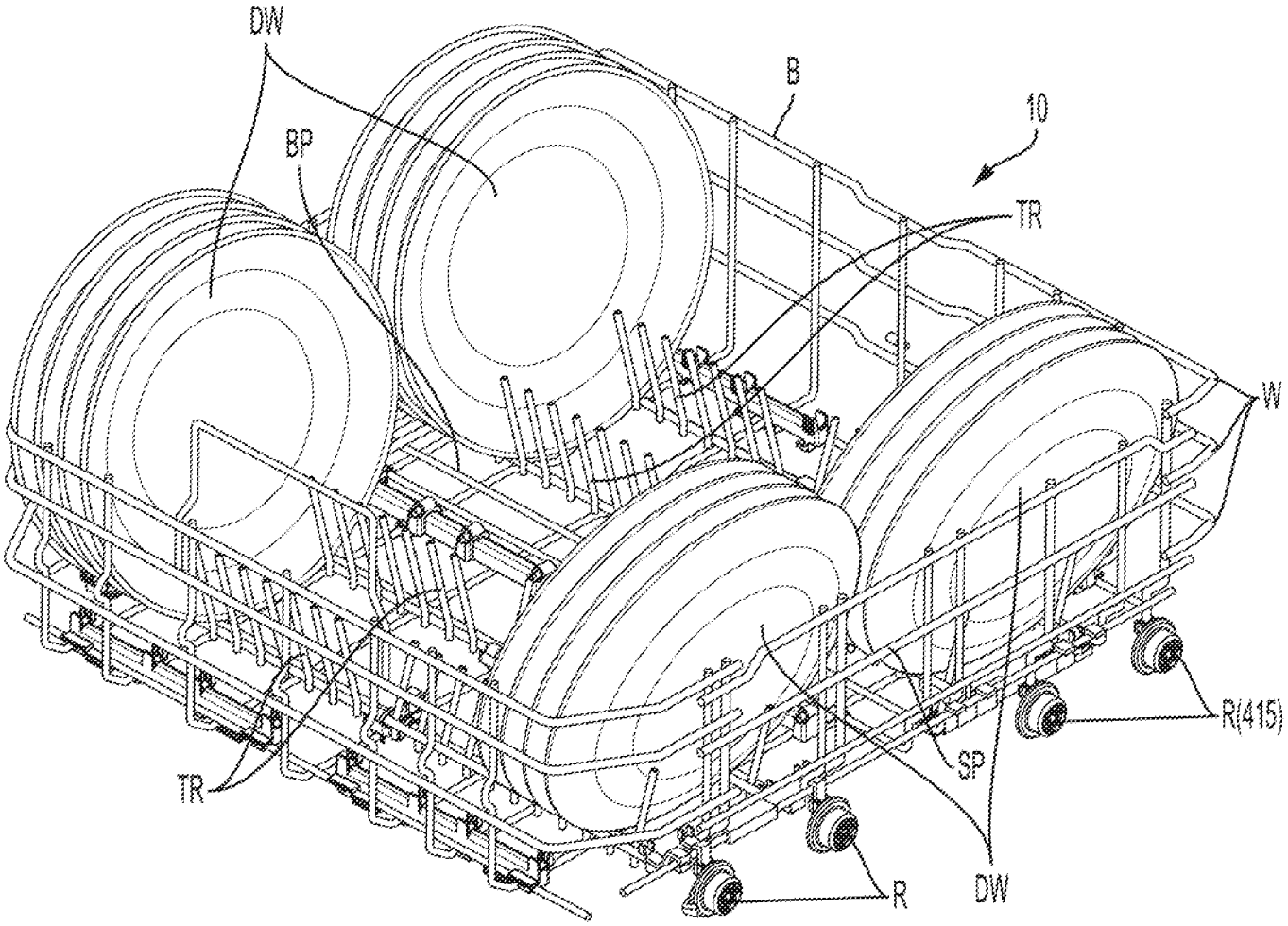
Figure 2C:
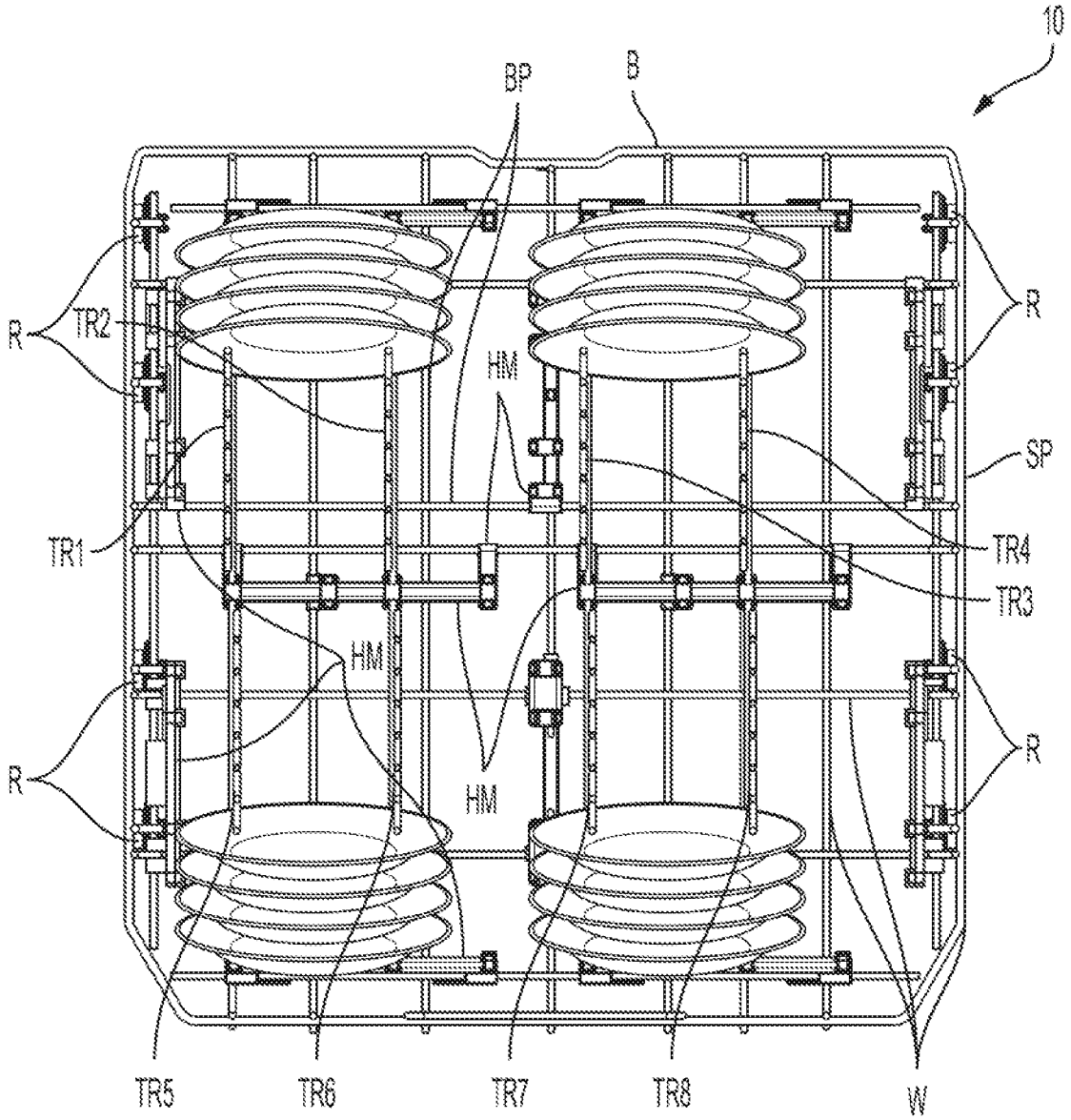
Figure 2D:
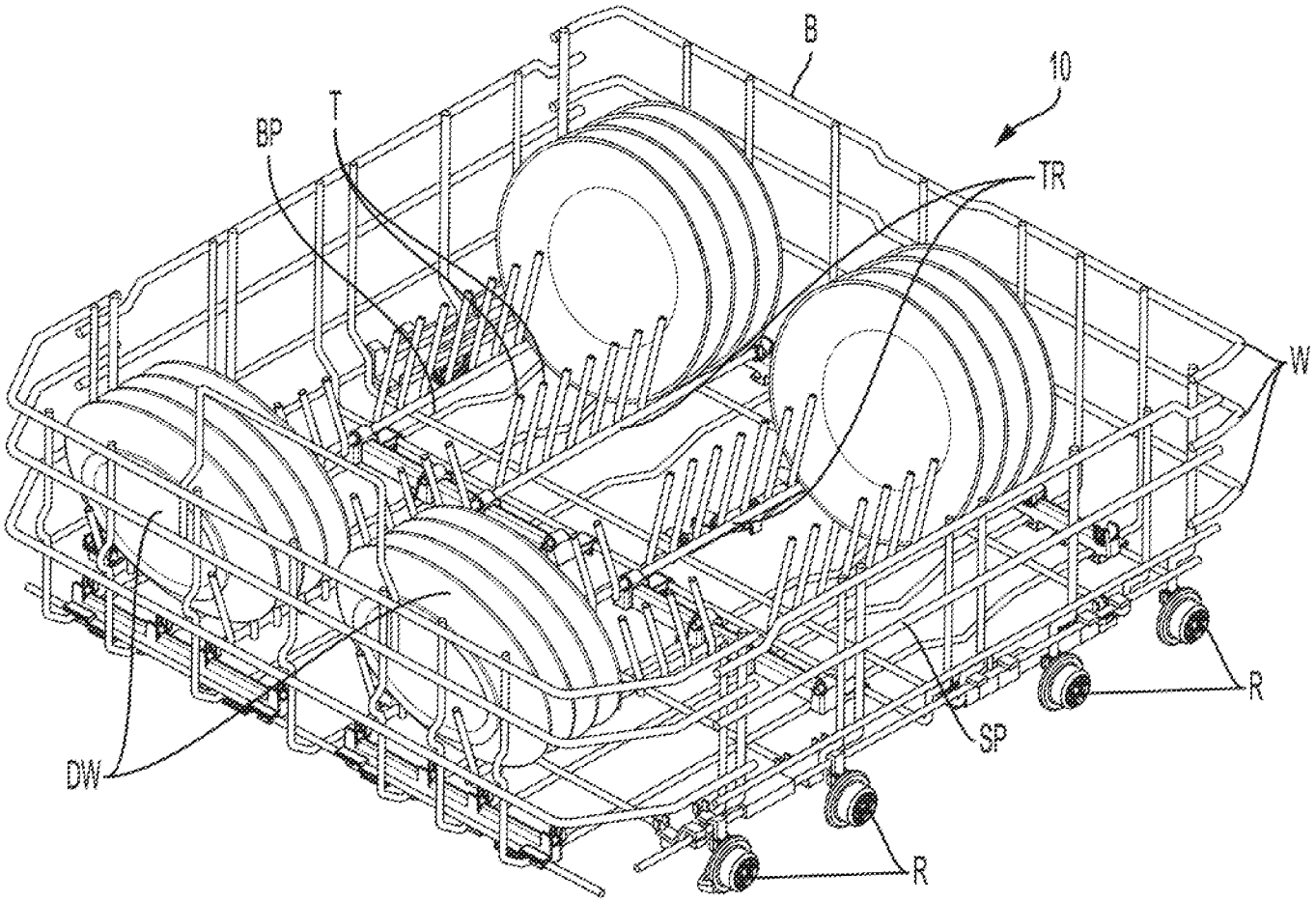
Figure 2E:
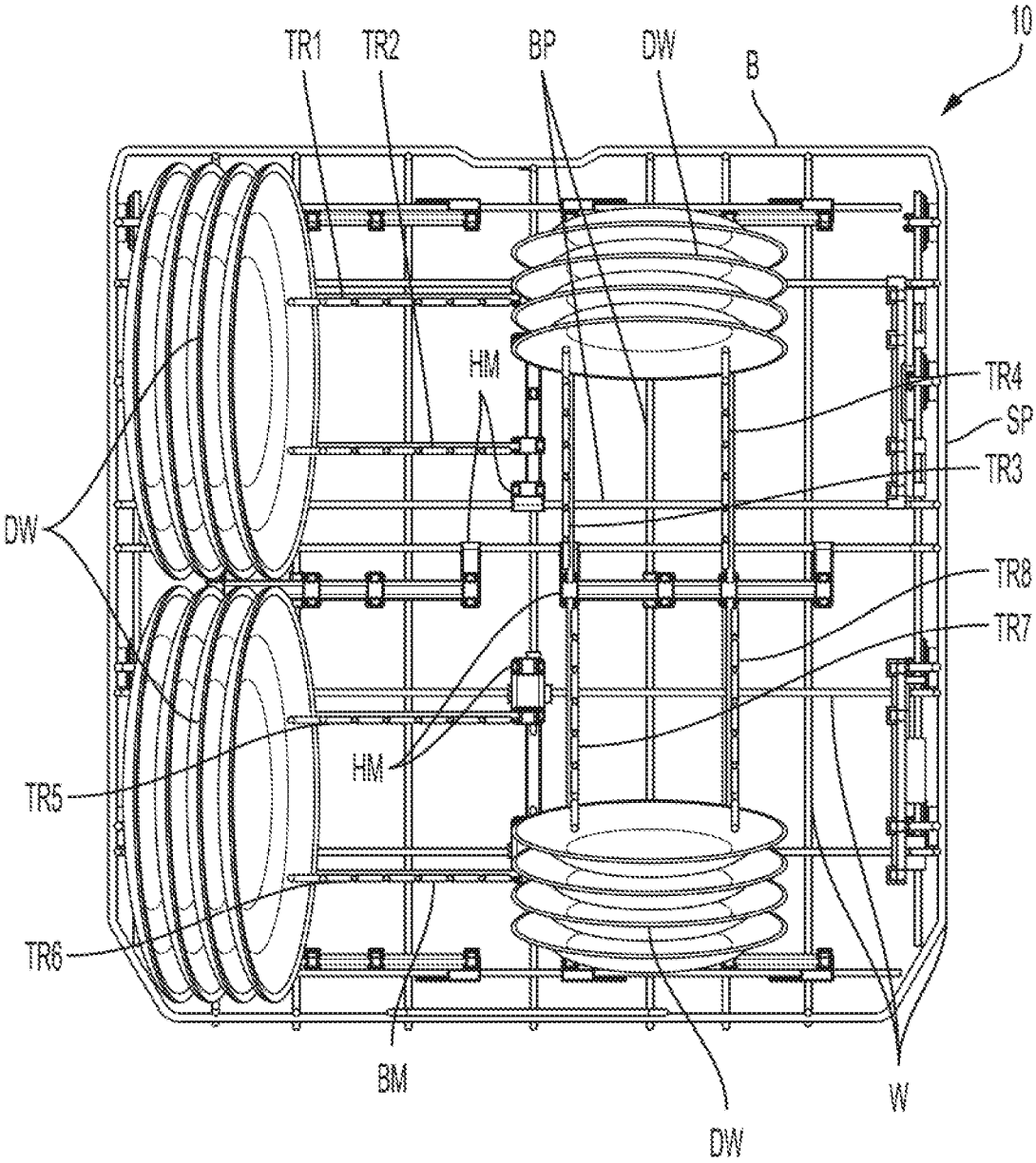
Figure 2F:
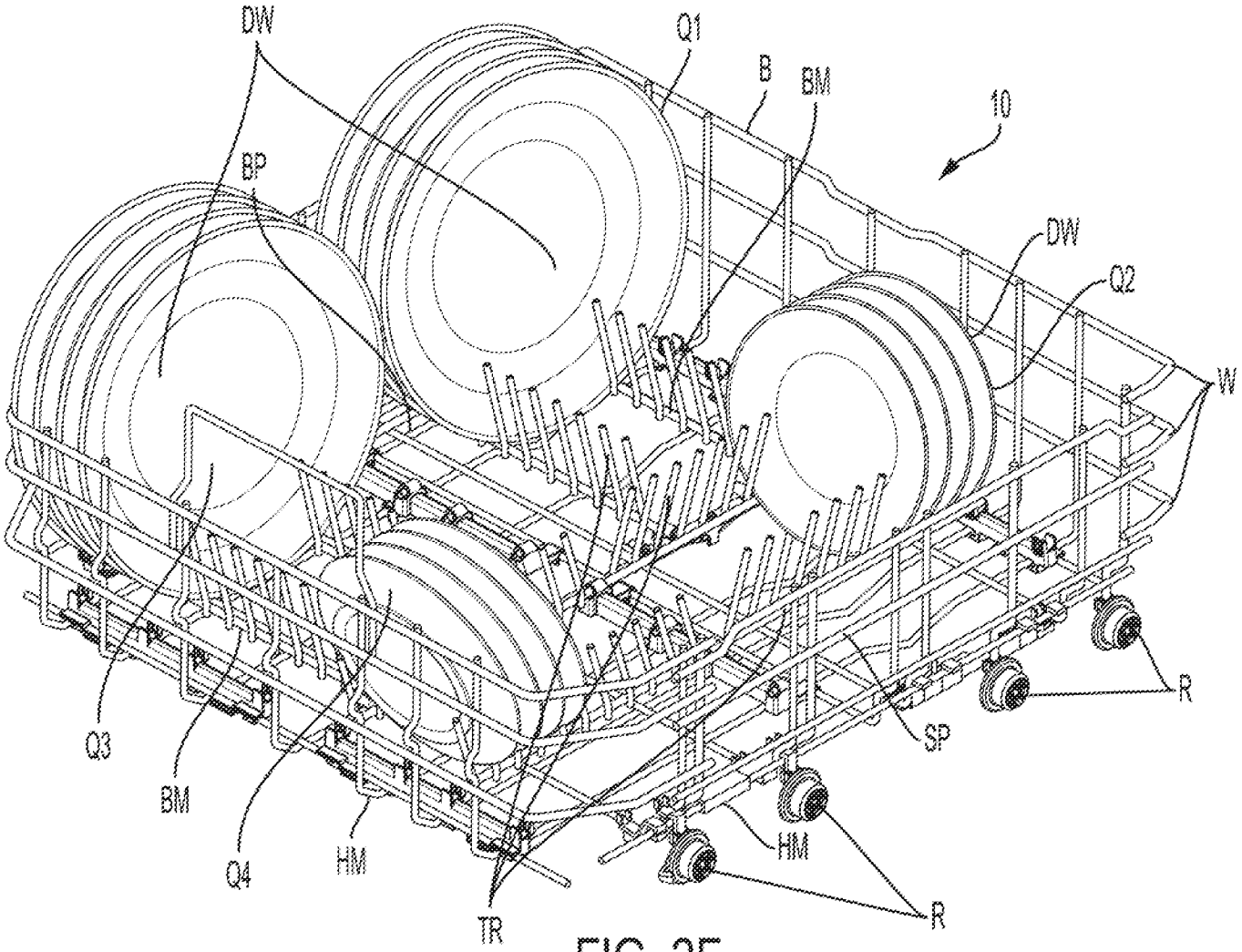

FIGS. 2A to 2F show customizable orientation of the tines in the form of: a horizontal arrangement (i.e., washware arranged from side-to-side of the washware rack)-FIGS. 2A and 2B, a vertical arrangement (i.e., washware arranged from front-to-back of the washware rack)—FIGS. 2C and 2D, or a mix and match arrangement of both horizontal and vertical—FIGS. 2E and 2F, according to an exemplary embodiment consistent with the present disclosure. In particular, the washware rack assembly 10 includes the basket B formed by a plurality of wire-shaped elements W, the plurality of wire-shaped elements W including a bottom portion BP and a side wall portion SP. When the washware rack assembly 10 is embodied as the lower washware rack 400 as described above in connection with FIG. 1, the basket B includes rollers 415 on each side that are configured to run on the corresponding flanges or track members TM on the inside wall of the dishwashing compartment 101 and also on an inside surface of the door D. For example, four rollers R may be provided on each side of the basket B and grouped in pairs for a total of eight rollers. The rollers R are configured to, for example, snap on to the right and left sides of the basket B via roller mounts RM (see FIG. 7). The decorative cover piece on the handle 445 of the basket B has been removed in FIGS. 2A-2F, 7, 8, and 10A for ease of understanding.

The washware rack assembly 10 further includes a plurality of removable, preformed rows of tines (or tine rows) generally denoted as TR in FIGS. 2A-4D, 6, and 7 and specifically identified as TR1 through TR8 in FIGS. 2A-2F and configured to mount to the bottom portion BP of the basket B either directly or via holding members to provide various configurations as described in detail below. More specifically, each removable, preformed row of tines TR1-TR8 is formed as a rod-shaped base member BM having a plurality of individual tines T extending therefrom and having a fixed spacing between the individual tines T. Moreover, the fixed spacing between the individual tines T (also referred to as the tine-slot spacing) can be different for individual tine rows TR. For example, there can be four different fixed tine-slot spacings between tines T for individual tine rows TR as will be described in more detail below in connections with FIGS. 4A-4D. The rod-shaped base member BM of each removable, preformed row of tines TR1-TR8 has one end that is preferably, but not necessarily, round and is configured to fit into round openings O (see especially FIGS. 3C and 3D) formed in one of, for example, four bar-shaped holding members HM disposed in a cross shape extending out from a central portion of the bottom portion BP of the basket B. The other end of each rod-shaped base member BM of a corresponding tine row TR has a bent end portion 30 (see FIG. 6) that is inserted into a slot 40 formed in one of, for example, eight bar-shaped holding members HM disposed along the edge or perimeter of the bottom portion BP of the basket B near the side wall portions SP. As will be discussed in detail in connection with FIG. 6, by having round ends at one end of the tine rows TR disposed in round openings O thereby allows each tine row TR to be rotated down from a vertical use position to a stowed position for more flexibility.

Each bar-shaped holding member HM has, for example, four openings O for receiving the end of a corresponding rod-shaped base member BM of a removable, preformed row of tines TR if located in the central portion of the bottom portion BP of the basket B, or four slots 40 if located along the edge of the bottom portion BP of the basket B near the side wall portions SP. The bar-shaped holding members HM are configured to snap or clip via clips C onto the wire-shaped elements W that form the bottom portion BP of the basket B in different sections of the basket B. The different sections of the basket B comprise, for example, four quadrants Q1 through Q4 of substantially equal size. The bottom portion BP of the basket B can have a multitude of individual bar-shaped holding members HM clipped thereon (for example, but not limited to, twelve), with, for example, the eight bar-shaped holding members HM disposed along the edge or perimeter of the bottom portion BP of the basket B near the side wall portions SP, and the four bar-shaped holding members HM disposed in a cross shape extending out from the central portion of the bottom portion BP of the basket B. Note that FIGS. 9A-9F show more details regarding the clips C in connection with a smaller version of the bar-shaped holding members HM, as will be discussed below.

With such a configuration of the bar-shaped holding members HM, a pair of the removable, preformed rows of tines TR1, TR2 are disposed in parallel horizontally in one section of the basket B, e.g., quadrant Q1, another pair of the removable, preformed rows of tines TR3, TR4 are disposed in parallel horizontally in another section of the basket B, e.g., quadrant Q2, another pair of the removable, preformed rows of tines TR5, TR6 are disposed in parallel horizontally in another section of the basket B, e.g., quadrant Q3, and another pair of the removable, preformed rows of tines TR7, TR8 are disposed in parallel horizontally in another section of the basket B, e.g., quadrant Q4 (see FIGS. 2A and 2B). This then allows the dishware DW to be arranged from front to back in the basket B. Similarly, as shown in FIGS. 2C and 2D, a pair of the removable, preformed rows of tines TR1, TR2 are disposed in parallel vertically in one section of the basket B, e.g., quadrant Q1, another pair of the removable, preformed rows of tines TR3, TR4 are disposed in parallel vertically in another section of the basket B, e.g., quadrant Q2, another pair of the removable, preformed rows of tines TR5, TR6 are disposed in parallel vertically in another section of the basket B, e.g., quadrant Q3, and another pair of the removable, preformed rows of tines TR7, TR8 are disposed in parallel vertically in another section of the basket B, e.g., quadrant Q4. This then allows the dishware DW to be arranged from side-to-side in the basket B. Finally, as shown in FIGS. 2E and 2F, the pairs of the removable, preformed rows of tines TR can be mixed and matched such that a pair of the removable, preformed rows of tines TR1, TR2 are disposed in parallel horizontally in one section of the basket B, e.g., quadrant Q1, another pair of the removable, preformed rows of tines TR3, TR4 are disposed in parallel vertically in another section of the basket B, e.g., quadrant Q2, another pair of the removable, preformed rows of tines TR5, TR6 are disposed in parallel horizontally in another section of the basket B, e.g., quadrant Q3, and another pair of the removable, preformed rows of tines TR7, TR8 are disposed in parallel vertically in another section of the basket B, e.g., quadrant Q4. This then allows the dishware DW to be arranged both front to back and from side-to-side in the basket B. Such reconfiguring of the removable, preformed rows of tines TR can be easily performed by the user by, for example, simply pulling up on the end of each rod-shaped base member BM of a corresponding tine row TR having the bent end portion 30 (see FIG. 6) that is inserted into a slot 40 and then pulling out the opposite end that is disposed in the one of the round openings O. This then allows the user to change the orientation of the tine rows TR from horizontal to vertical or vice versa by inserting their one ends into the openings O of another one of the centrally located bar-shaped holding members HM and inserting their other ends into a corresponding slot 40 formed in another one of the bar-shaped holding members HM disposed along the edge or perimeter of the bottom portion BP of the basket B near the side wall portions SP.

Figure 3B:
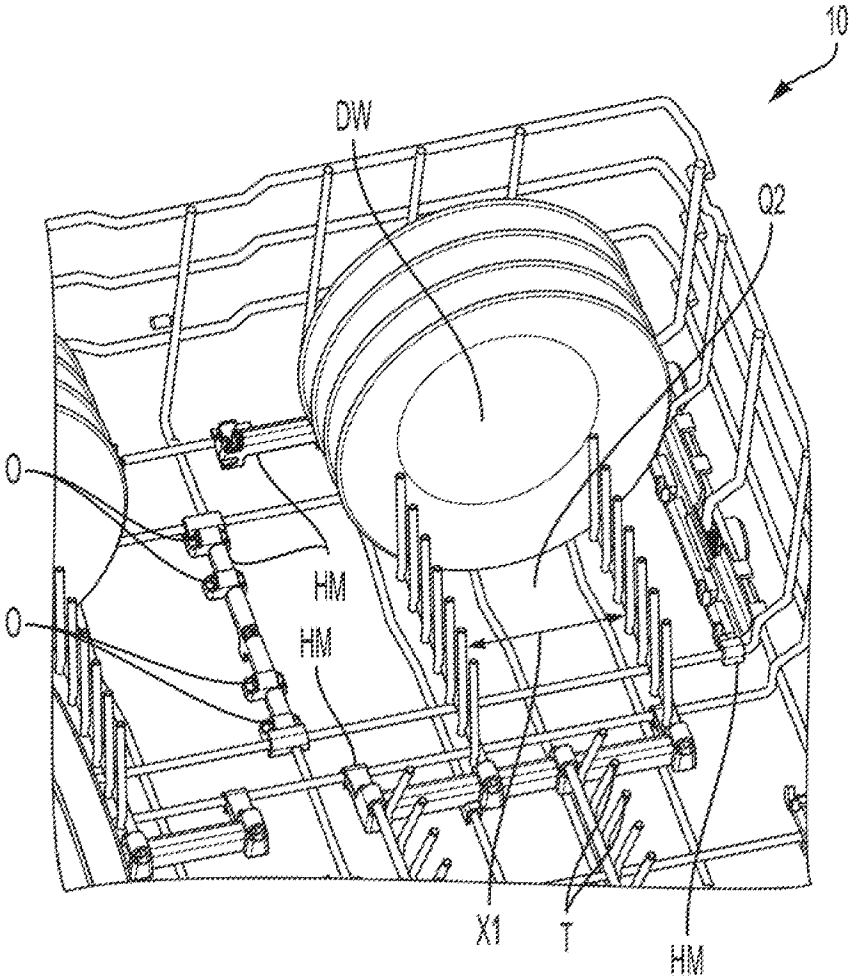
Figure 3A:
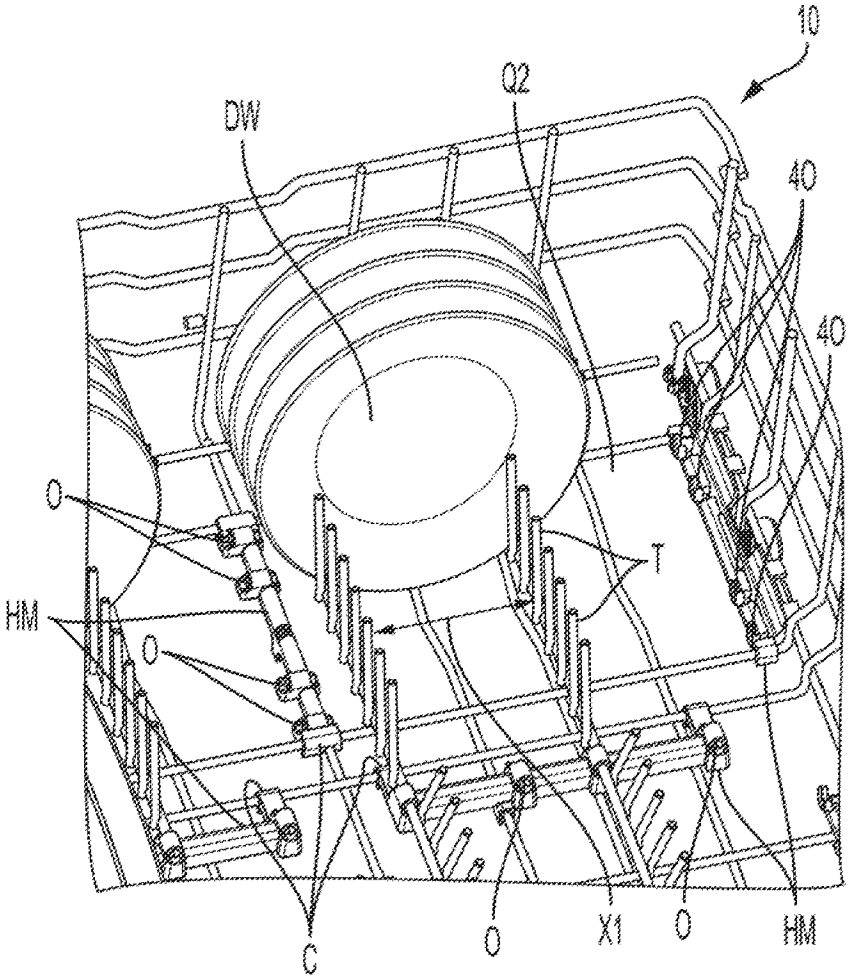
Figure 3D:
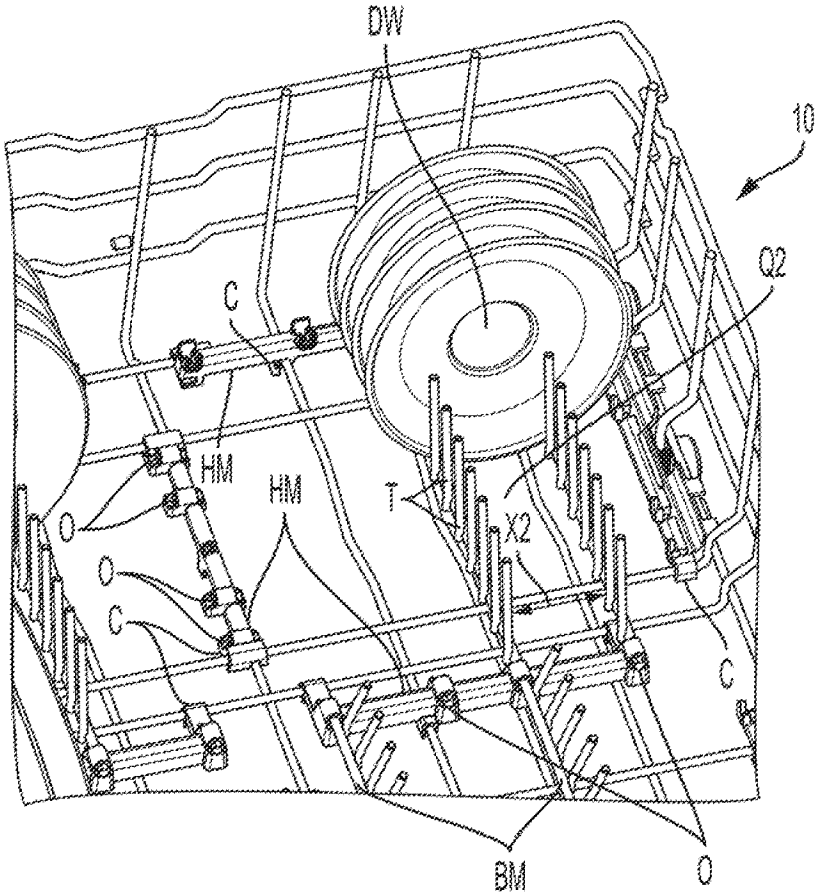
Figure 3C:
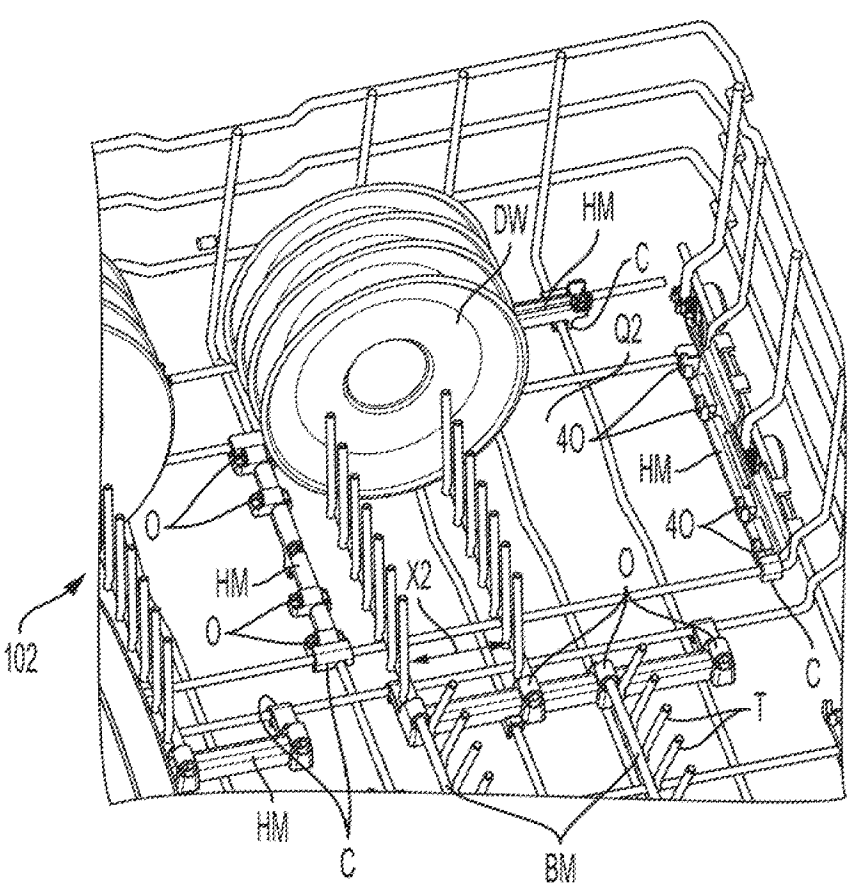

While the reconfiguration operation described above with respect to FIGS. 2A-2F kept the spacing between the various tine rows TR uniform and the location within each quadrant the same when changing the orientation from horizontal to vertical or vice versa, FIGS. 3A-3D show how the spacing between the various pairs of the removable, preformed rows of tines TR can be varied within each quadrant Q1-Q4 and the location of the pairs of the removable, preformed rows of tines TR within each quadrant Q1-Q4 can be changed. In this case, FIGS. 3A-3D focus on quadrant Q2 merely as an example and show all of the pairs of the removable, preformed rows of tines TR in a vertical orientation such that the dishware is arranged from side-to-side in the basket B. For example, FIGS. 3A and 3B show the removable, preformed rows of tines TR shifted left and right, respectively, while having a larger spacing X1 therebetween. On the other hand, FIGS. 3C and 3D show the removable, preformed rows of tines TR shifted left and right, respectively, while having a smaller spacing X2 therebetween. The pair of the removable, preformed rows of tines TR disposed in parallel in each of the four quadrants Q1-Q4 are adjustable by the user with respect to the plurality of wire-shaped elements W of the bottom portion BP of the basket B in order to vary the spacing between the pair of the removable, preformed rows of tines TR disposed in parallel in each of the four quadrants. The adjustment can be carried out by the user again by simply pulling up on the end of each rod-shaped base member BM of a corresponding tine row TR having the bent end portion 30 (see FIG. 6) that is inserted into a slot 40 and then pulling out the opposite end that is disposed in the one of the round openings O, thereby to either change the spacing between the pair of tine rows TR or shift them from one side of the quadrant to another. While four openings O are shown in each of the four centrally located bar-shaped holding members HM and four slots 40 are formed in each of the eight perimeter bar-shaped holding members HM, clearly more or less openings O and slots 40 can be formed therein.

Figure 4B:
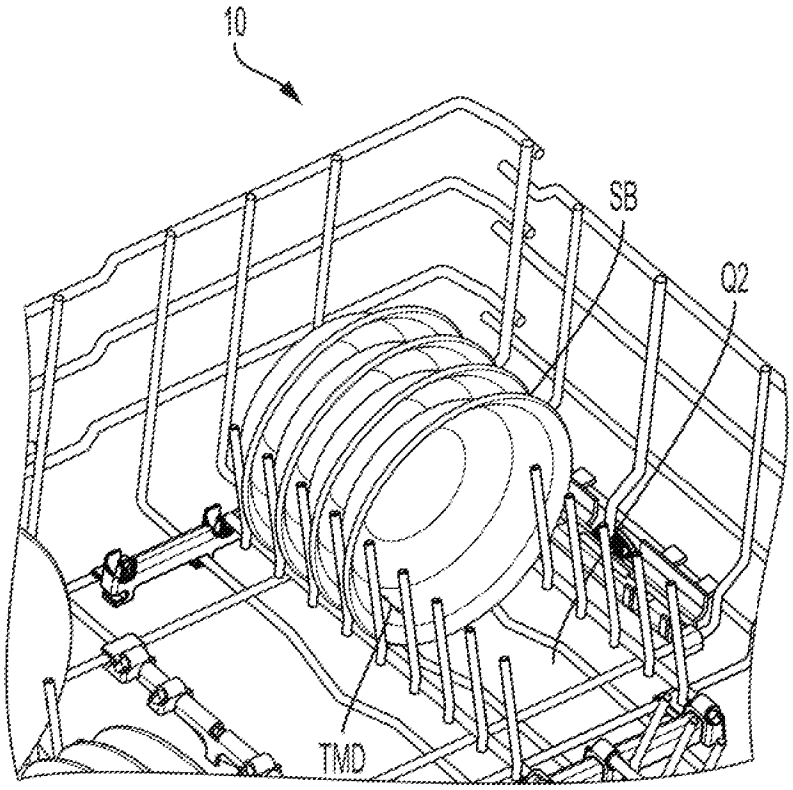
FIGS. 4A to 4D show various tine slot spacing, including small—FIG. 4A, medium—FIG. 4B, large—FIG. 4C, and extra-large—FIG. 4D, according to an exemplary embodiment consistent with the present disclosure.
Figure 4A:
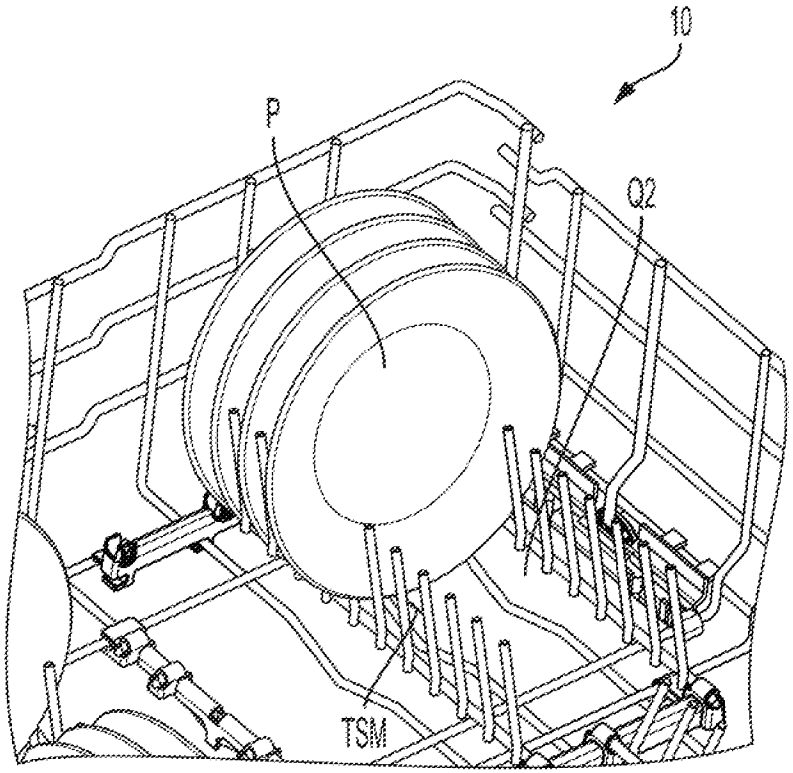
Figure 4D:
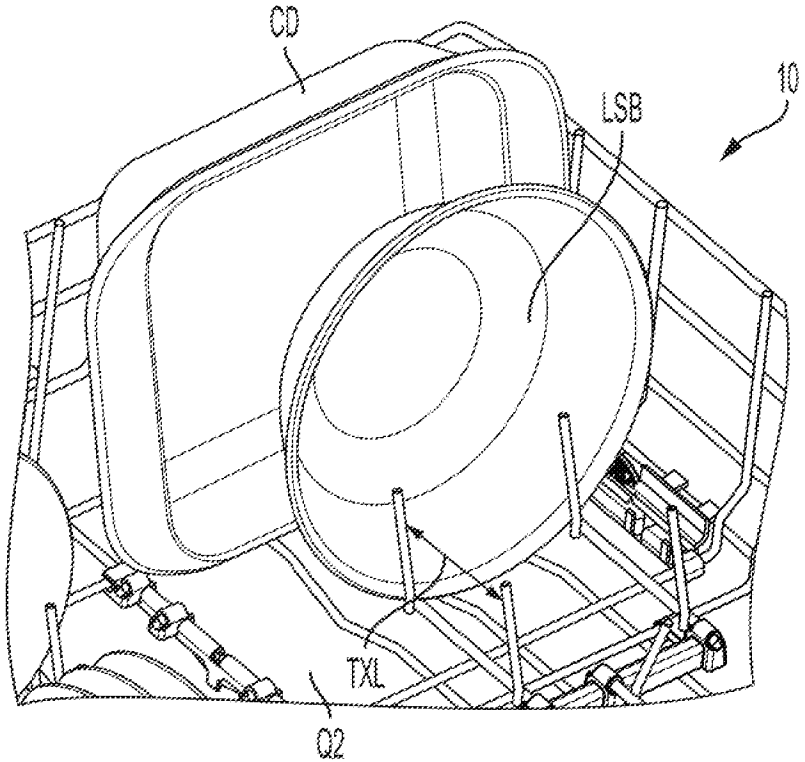
Figure 4C:
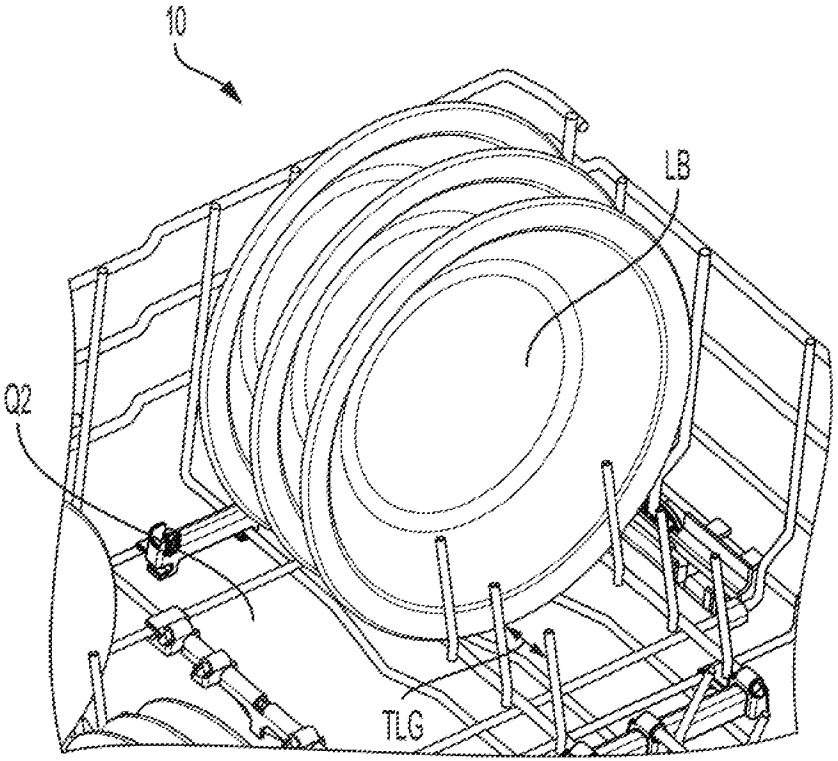

Again with a focus on quadrant Q2 merely as an example, FIGS. 4A to 4D show various tine-slot spacings, including small—FIG. 4A, medium—FIG. 4B, large—FIG. 4C, and extra-large—FIG. 4D, according to an exemplary embodiment consistent with the present disclosure. More specifically, as shown in FIG. 4A, a pair of the removable, preformed rows of tines TR having the first (e.g., small), fixed spacing or tine-slot spacing TSM are disposed in parallel in quadrant Q2 of the basket B for accommodating thinner washware such as plates P. As shown in FIG. 4B, a pair of the removable, preformed rows of tines TR having the second (e.g., medium), fixed spacing TMD are disposed in parallel in quadrant Q2 of the basket B for accommodating washware having more depth such as small bowls SB. As shown in FIG. 4C, a pair of the removable, preformed rows of tines TR having the third (e.g., large), fixed spacing TLG are disposed in parallel in quadrant Q2 of the basket B for accommodating washware having even greater depth such as large bowls LB. Finally, as shown in FIG. 4D, a pair of the removable, preformed rows of tines TR having the fourth (e.g., extra-large), fixed spacing TXL are disposed in parallel in quadrant Q2 of the basket B for accommodating washware having still greater depth such as large serving bowls LSB or casserole dishes CD, such that the washware rack assembly is configured to accommodate washware of different sizes in different sections of the basket. Accordingly, pairs of the removable, preformed rows of tines TR having the fixed spacing TSM, or TMD, or TLG, or TXL can be disposed in parallel in any one of the quadrants Q1-Q4 so that special quadrants can be created to hold different types of dishware thereby providing for full versatility. The user can thus modify a particular quadrant Q1-Q4 by simply removing the pair of removable, preformed rows of tines TR having one fixed spacing, e.g., TSM, for another pair of removable, preformed rows of tines TR having a different fixed spacing, e.g., TXL, to accommodate large dishware as an example.

Figure 5:
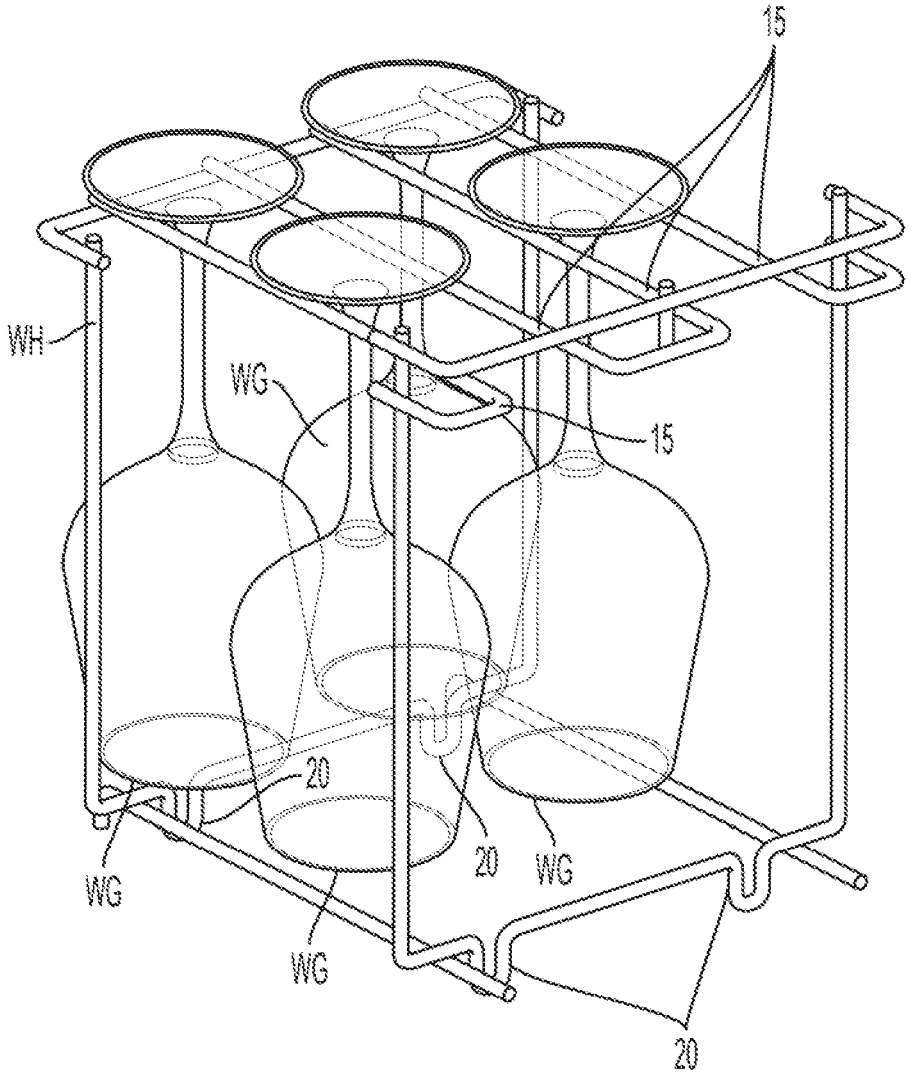
FIG. 5 shows an accessory such as a wine glass holder for accommodation in one of the four quadrants according to an exemplary embodiment consistent with the present disclosure.
Figure 7:
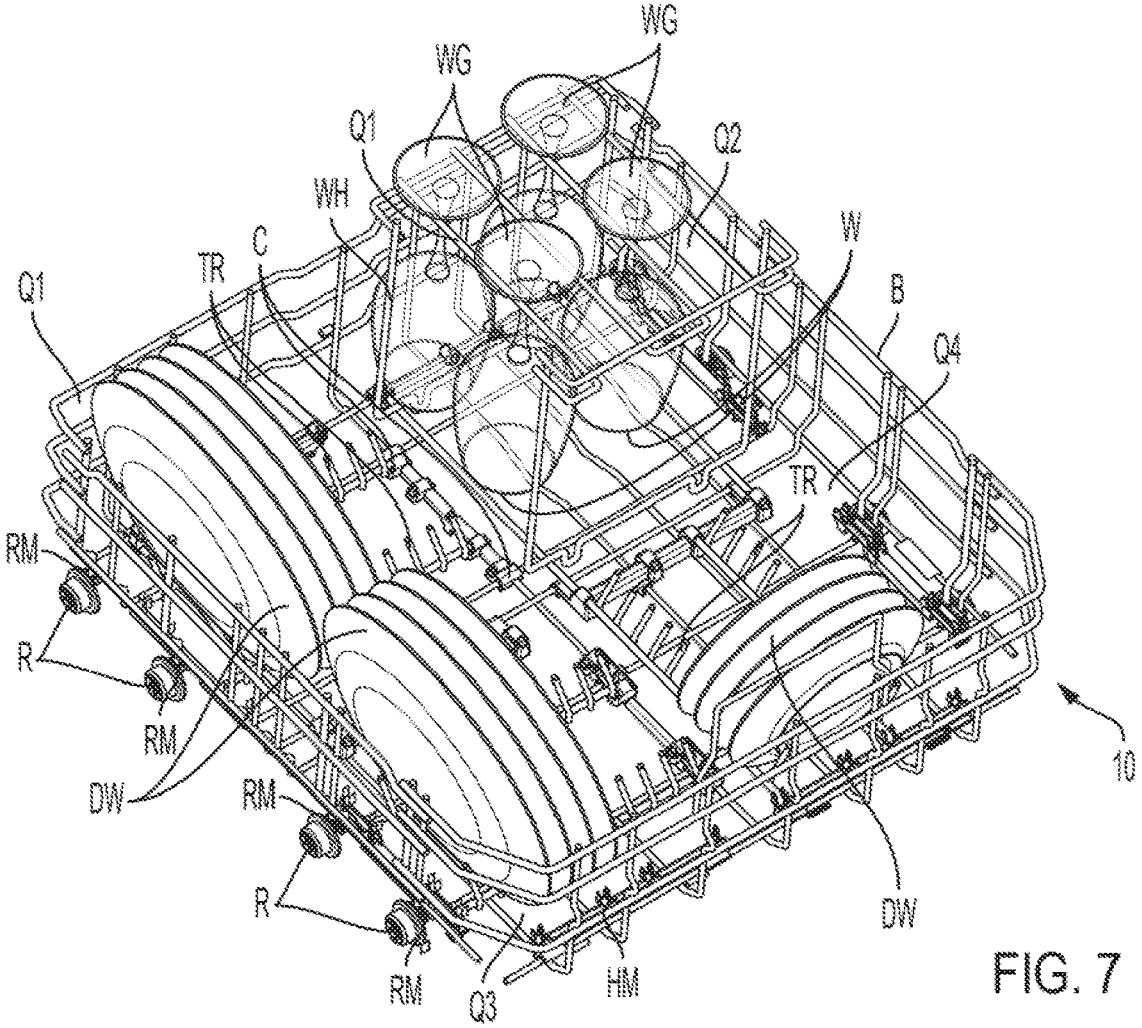
FIG. 7 shows a basket with each of the four quadrants accommodating different configurations for holding various different sizes and shapes of washware according to an exemplary embodiment consistent with the present disclosure.

FIG. 5 shows an accessory such as a wine glass holder for accommodation in one of the four quadrants according to an exemplary embodiment consistent with the present disclosure. In particular, FIG. 5 is enlarged view of a wine glass holder WH shown holding four stemmed wine glasses WG. The wine glass holder WH can be formed by a plurality of wire-shaped elements that form two parallel tracks 15 for holding the base of each wine glass WG. FIG. 7 shows the wine glass holder WH in quadrant Q2 and resting on the bottom portion BP of the basket B. Two pairs of ribs 20 can be provided at the base of the wine glass holder WH to be inserted between parallel wire-shaped elements W of the bottom portion BP of the basket B for stability side-to-side in the basket B. Other specialty item holders are contemplated such as, but not limited to, a bottle holder, a lid holder, and the like.

Figure 6:
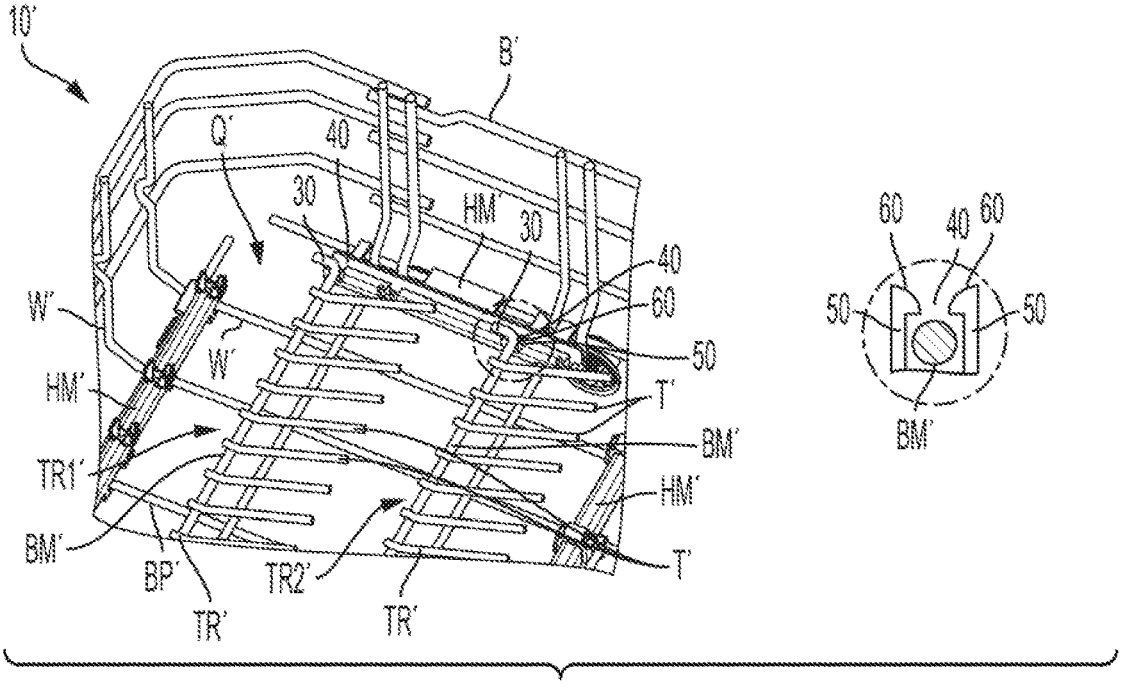
FIG. 6 is an enlarged view of one of the holding members showing how the tines can be folded or rotated down when not in use.

FIG. 6 is an enlarged view of a representative one of the peripheral or perimeter holding members HM' of the washware rack assembly 10' where the tines T' on individual tine rows TR' are folded or rotated down when not in use. This peripheral holding member HM' is representative of one of the eight bar-shaped holding members HM disposed around the edge of the bottom portion BP of the basket B near the side wall portions SP shown in FIGS. 2-5 and 7. Like elements are denoted by like references numerals/characters but with a prime sign. More specifically, a pair of the removable, preformed rows of tines, for example, TR1', TR2' are disposed in parallel in one section or quadrant Q' of the basket B'. Each individual tine row TR1' and TR2' is mounted at one end to allow for being rotated (only the one end is visible in FIG. 6) to a corresponding peripheral bar-shaped holding member HM' that is disposed along the edge of the bottom portion BP' of the basket B' near the side wall portions SP' on the wire-shaped elements W'. The other end of each individual tine row TR1' and TR2' is inserted into one of the round openings O formed in a corresponding one of the four centrally located bar-shaped holding members HM disposed in a cross shape extending out from a central portion of the bottom portion BP of the basket B (see especially FIGS. 3C and 3D). The one ends of the tine rows TR1' and TR2' have the bent end portions 30 that are bent at right angles with respect to the rod-shaped base member BM' of the corresponding tine row TR1', TR2'. The bent end portions 30 are configured to fit into the slots 40 formed in the peripheral bar-shaped holding members HM'. The slots 40 have opposing pairs of projections 50 with pawls 60 on the free ends. The pawls 60 allow the bent end portions 30 to easily snap into the slots 40 but then holds the ends of the tine rows TR1' and TR2'. If the user wants to place the individual tine rows TR' in a non-use position, they simply pull up on the end with the bent portion 30 to free it from the peripheral bar-shaped holding member HM', then they turn or rotate the tine row TR' (the opposite end rotating in an opening O not visible in FIG. 6) so that the bent end portion 30 is now horizontally oriented. The user then snaps the end of the rod-shaped base member BM' of the tine row TR' down through the pawls 60 of the slot 40 such that the bent end portion 30 is now horizontally disposed in the peripheral bar-shaped holding member HM' as is shown in FIG. 6. In this way, the individual tine rows TR' can be folded or rotated down as shown in FIG. 6 against the bottom portion BP' of the basket B' when not in use. If a user wants to return the individual tine rows TR' to an upright use position, then the user simply lifts the rod-shaped base member BM' and the bent end portion 30 of the tine row TR' from the slot 40 and then rotates the tine row TR' to the upright position so that the bent end portion 30 is now vertical. The user then snaps the rod-shaped base member BM' down through the pawls 60 of the slot 40 and pushes the bent end portion 30 straight down into a vertical opening (not visible) in the peripheral bar-shaped holding member HM'.

FIG. 7 shows a basket B with each of the four quadrants Q1-Q4 accommodating different configurations for holding various different sizes and shapes of washware/dishware DW including, for example, a wine glass holder WH with four wine glasses WG, small bowls, large plates, and small plates in quadrants Q1-Q4, respectively, according to an exemplary embodiment consistent with the present disclosure.

FIG. 8 shows a washware rack assembly 10" with an alternative form of holding members according to an exemplary embodiment consistent with the present disclosure. Like elements are denoted by like references numerals/characters but with a double prime sign. In particular, the holding members SHM are smaller than the holding members HM in the embodiment of FIGS. 1-7. The smaller holding members SHM also clip onto the bottom portion BP" of the basket B". Both the holding members HM and the smaller holding members SHM can be formed of plastic material such as, but not limited to, polyoxymethylene (POM). Opposite ends of each tine row TRX having individual tines TX on a rod-shaped base member BMX are mounted to a respective smaller holding member SHM. As better shown in FIGS. 9A to 9F, the smaller holding members SHM comprise two different forms; namely, 1) a first smaller holding member SHM1 that is configured to clip or snap via clips CX1 onto a pair of perpendicular wire-shaped elements W" of an inner portion of the bottom portion BP" and has a pair of round openings O" each configured to receive the free ends of tine rows TRX at either side, and 2) a second smaller holding member SHM2 that is configured to clip or snap via clips CX2 onto a pair of perpendicular wire-shaped elements W" of a peripheral portion of the basket B" where the side wall portion SP" meets the bottom portion BP" of the basket B" and has a pair of vertical openings VO for receiving vertical pegs VP formed on opposite ends of the tine rows TRX.

FIGS. 10A and 10B show a washware rack assembly 10'" with an alternative form of the tine row where the tine row TRY having individual tines TY on a rod-shaped base member BMY is directly mounted at opposite ends to the bottom portion BP'" of the basket B'" via clips C1 and C2 according to an exemplary embodiment consistent with the present disclosure. Like elements are denoted by like references numerals/characters but with a triple prime sign. In other words, no separate holding members HM or smaller holding members SHM are used. Rather, the clips C1 and C2 are formed directly as part of the tine row TRY on opposite ends of the rod-shaped base member BMY. For example, clip C1 is formed as a bent portion of wire with another loop of wire fixed, such as by welding, proximate thereto and clips onto the wire-shaped element W" at a peripheral portion of the base portion BP'" of the basket B'", while clip C2 is formed as a three-pronged fork-shaped member by fixing, such as by welding, a two-pronged member underneath the rod-shaped base member BMY at one end thereof. In this way, the two-pronged member cooperates with the end of the rod-shaped base member BMY to provide the three mounting prongs P1-P3 that fit over the wire-shaped element W", two prongs P2 and P3 below the wire-shaped element W" and one prong P1 above the wire-shaped element W" at an inner portion of the base portion BP'" of the basket B'", as shown in FIG. 10A. Other configurations of the clips C1 and C2 are contemplated. For example, but not limited to, C1 can be a simple single hook shape formed by bending an end of the wire forming the rod-shaped base member BMY of tine row TRY, a double hook shape fixed, such as by welding, to an end of the wire forming the rod-shaped base member BMY, or a small clip-on member at one end of the wire forming the rod-shaped base member BMY used together with a clip C2 that is the three-pronged fork-shaped member at the other end. Also, a vertical peg (e.g., see FIG. 9E) could be formed at one end of the wire forming the rod-shaped base member BMY of tine row TRY and that is inserted into a small clip-on member, while the other end of the wire forming the rod-shaped base member BMY is simply round in cross-section and thus devoid of any clip.

Accordingly, consistent with the present disclosure, with the configurable washware rack assembly, tines can be moved to be closer together to better support small plates. Or tines can be moved further away from each other to better support big items like a casserole dish or serving plate. Another advantage of the configurable washware rack assembly is that two sets of tines can be positioned to be close together so that they can be used for small plates and at the same time create open space in the basket for loading an additional item that does not need tines to support it. Also, the fixed spacing between the individual tines can be different for individual tine rows. Still further, special quadrants can be created to hold different types of dishware such as, for example: wine glasses, lids, pots and pans, etc. This can be modular in contrast to traditional tine style.

The present invention has substantial opportunity for variation without departing from the spirit or scope of the present invention. For example, while the lower washware rack 400 is provided in the form of a washware rack assembly that is configured to accommodate washware of different sizes in different sections, other washware racks, such as the middle washware rack or upper washware rack can also be configured to accommodate washware of different sizes in different sections consistent with the present disclosure. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A dishwasher, comprising:

a dishwashing compartment having a loading opening;

a door configured to close the loading opening;

at least one washware rack configured as a basket formed by a plurality of wire-shaped elements, the plurality of wire-shaped elements including a bottom portion and a side wall portion and being configured for movement out of and into the dishwashing compartment; and a plurality of holding members positioned on the bottom portion of the at least one washware rack, each holding member of the plurality of holding members comprising a plurality of receiving openings spaced apart laterally from one another, each receiving opening of the plurality of receiving openings sized to (i) receive, in a first direction, a first row of tines of a pair of removable, preformed rows of tines, and (ii) receive, in a second direction, a second row of tines of the pair of removable, preformed rows of tines, at least one holding member of the plurality of holding members arranged nonparallel to other holding members of the plurality of holding members, and an upper surface of each holding member of the plurality of holding members configured to receive the pair of removable, preformed rows of tines such that the pair of removable, preformed rows of tines are positionable on top of a corresponding holding member of the plurality of holding members, wherein the pair of removable, preformed rows of tines are included in a plurality of removable, preformed rows of tines, and wherein the pair of removable, preformed rows of tines are receivable in a plurality of different configurations, wherein the at least one washware rack comprises the plurality of removable, preformed rows of tines configured to mount to the basket via the plurality of holding members, the plurality of removable, preformed rows of tines including at least tines having a first, fixed spacing and tines having a second, fixed spacing which is different than the first, fixed spacing, and wherein a pair of the removable, preformed rows of tines having the first, fixed spacing is disposed in parallel in one section of the basket, and a pair of the removable, preformed rows of tines having the second, fixed spacing is disposed in parallel in another section of the basket, such that the at least one washware rack is configured to accommodate washware of different sizes in different sections of the basket.

2. The dishwasher of claim 1, wherein the different sections of the basket comprise four quadrants of substantially equal size, wherein each of the four quadrants of the basket includes a pair of the removable, preformed rows of tines disposed in parallel, and wherein a fixed spacing of the tines of the removable, preformed rows of tines in one quadrant is different than the fixed spacing of the tines of the removable, preformed rows of tines in the other quadrants in order to accommodate washware of different sizes.

3. The dishwasher of claim 2, wherein the pair of the removable, preformed rows of tines disposed in parallel in each of the four quadrants is adjustable with respect to the plurality of wire-shaped elements of the bottom portion of the basket in order to vary the spacing between the pair of the removable, preformed rows of tines disposed in parallel in each of the four quadrants.

4. The dishwasher of claim 2, wherein the pair of the removable, preformed rows of tines disposed in parallel in each of the four quadrants is configured to be removed and replaced by another pair of the removable, preformed rows of tines having a different fixed spacing between the tines.

5. The dishwasher of claim 2, wherein at least one of the four quadrants accommodates a specialty item holder including at least one of a wine glass holder, a bottle holder, or a lid holder.

6. The dishwasher of claim 1, wherein the at least one washware rack comprises a lower modular washware rack.

7. A washware rack assembly for a dishwasher configured to receive washware therein and to be inserted into and removed from a dishwashing compartment of the dishwasher, the washware rack assembly comprising:

a basket formed by a plurality of wire-shaped elements, the plurality of wire-shaped elements including a bottom portion and a side wall portion;

a plurality of holding members positioned on the bottom portion, each holding member of the plurality of holding members comprising a plurality of receiving openings spaced apart laterally from one another, each receiving opening of the plurality of receiving openings sized to (i) receive, in a first direction, a first row of tines of a pair of removable, preformed rows of tines, and (ii) receive, in a second direction, a second row of tines of the pair of removable, preformed rows of tines, at least one holding member of the plurality of holding members arranged nonparallel to other holding members of the plurality of holding members, and an upper surface of each holding member of the plurality of holding members configured to receive the pair of removable, preformed rows of tines such that the pair of removable, preformed rows of tines are positionable on top of a corresponding holding member of the plurality of holding members, wherein the pair of removable, preformed rows of tines are included in a plurality of removable, preformed rows of tines, and wherein the pair of removable, preformed rows of tines are receivable in a plurality of different configurations of the pair of removable, preformed rows of tines; and the plurality of removable, preformed rows of tines configured to mount to the basket via the plurality of holding members, the plurality of removable, preformed rows of tines including at least tines having a first, fixed spacing and tines having a second, fixed spacing which is different than the first, fixed spacing, wherein a pair of the removable, preformed rows of tines having the first, fixed spacing is disposed in parallel in one section of the basket, and a pair of the removable, preformed rows of tines having the second, fixed spacing is disposed in parallel in another section of the basket, such that the washware rack assembly is configured to accommodate washware of different sizes in different sections of the basket.

8. The washware rack assembly of claim 7, wherein the different sections of the basket comprise four quadrants of substantially equal size.

9. The washware rack assembly of claim 8, wherein each of the four quadrants of the basket includes a pair of the removable, preformed rows of tines disposed in parallel, and wherein a fixed spacing of the tines of the removable, preformed rows of tines in one quadrant is different than the fixed spacing of the tines of the removable, preformed rows of tines in the other quadrants in order to accommodate washware of different sizes.

10. The washware rack assembly of claim 9, wherein the pair of the removable, preformed rows of tines disposed in parallel in each of the four quadrants is adjustable with respect to the plurality of wire-shaped elements of the bottom portion of the basket in order to vary the spacing between the pair of the removable, preformed rows of tines disposed in parallel in each of the four quadrants.

11. The washware rack assembly of claim 9, wherein the pair of the removable, preformed rows of tines disposed in parallel in each of the four quadrants is configured to be removed and replaced by another pair of the removable, preformed rows of tines having a different fixed spacing between the tines.

12. The washware rack assembly of claim 8, wherein at least one of the four quadrants accommodates a specialty item holder including at least one of a wine glass holder, a bottle holder, or a lid holder.

13. The washware rack assembly of claim 7, wherein the washware rack assembly comprises a lower modular washware rack.

14. A washware rack assembly for a dishwasher configured to receive washware therein and to be inserted into and removed from a dishwashing compartment of the dishwasher, the washware rack assembly comprising:

a basket formed by a plurality of wire-shaped elements, the plurality of wire-shaped elements including a bottom portion and a side wall portion, with the basket comprising four quadrants of substantially equal size;

a plurality of holding members positioned on the bottom portion, each holding member of the plurality of holding members comprising a plurality of receiving openings spaced apart laterally from one another, each receiving opening of the plurality of receiving openings sized to (i) receive, in a first direction, a first row of tines of a pair of removable, preformed rows of tines, and (ii) receive, in a second direction, a second row of tines of the pair of removable, preformed rows of tines, at least one holding member of the plurality of holding members arranged nonparallel to other holding members of the plurality of holding members, and an upper surface of each holding member of the plurality of holding members configured to receive the pair of removable, preformed rows of tines such that the pair of removable, preformed rows of tines are positionable on top of a corresponding holding member of the plurality of holding members, wherein the pair of removable, preformed rows of tines are included in a plurality of removable, preformed rows of tines, and wherein the pair of removable, preformed rows of tines are receivable in a plurality of different configurations of the pair of removable, preformed rows of tines; and the plurality of removable, preformed rows of tines configured to mount to the basket via the plurality of holding members, the plurality of removable, preformed rows of tines including tines having first, second, third, and fourth fixed spacing which are different from each other, with the tines having the first, second, third, and fourth fixed spacing being configured to be respectively disposed in a corresponding one of the four quadrants of the basket, wherein a pair of the removable, preformed rows of tines having one of the first, second, third, and fourth fixed spacing is configured to be disposed in parallel in each of the four quadrants of the basket, with at least two of the four quadrants of the basket having pairs of the removable, preformed rows of tines with a different one of the first, second, third, and fourth fixed spacing between the tines, and wherein the pair of the removable, preformed rows of tines configured to be disposed in parallel in each of the four quadrants of the basket is configured to be removed and replaced by another pair of the removable, preformed rows of tines having a different one of the first, second, third, and fourth fixed spacing between the tines, such that the washware rack assembly is configured to accommodate washware of different sizes in different quadrants of the basket.

15. The washware rack assembly of claim 14, wherein the pair of the removable, preformed rows of tines disposed in parallel in each of the four quadrants of the basket is adjustable with respect to the plurality of wire-shaped elements of the bottom portion of the basket in order to vary the spacing between the pair of the removable, preformed rows of tines disposed in parallel in each of the four quadrants of the basket.

16. The washware rack assembly of claim 14, wherein at least one of the four quadrants is configured such that the pair of the removable, preformed rows of tines disposed in parallel is removed and replaced by a specialty item holder including at least one of a wine glass holder, a bottle holder, or a lid holder.

17. The washware rack assembly of claim 14, wherein the washware rack assembly comprises a lower modular washware rack.

18. The washware rack assembly of claim 14, wherein each of the plurality of removable, preformed rows of tines is mounted at opposite ends to the bottom portion of the basket via holding members that clip onto corresponding wire-shaped elements.

19. The washware rack assembly of claim 14, wherein each of the plurality of removable, preformed rows of tines is directly mounted at opposite ends to the bottom portion of the basket.

20. The dishwasher of claim 1, wherein each removable, preformed row of tines of the plurality of removable, preformed rows of tines comprises:

a first side;

a second side positioned opposites the first side;

a first clip positioned on a bottom of the first side; and a second clip positioned on a bottom of the second side and opposite the first clip, wherein the first clip and the second clip are sized to attach each removable, preformed row of tines of the plurality of removable, preformed rows of tines to the bottom portion of the at least one washware rack.

* * * * *